US010577680B2

(12) United States Patent
Srivastava et al.

(10) Patent No.: US 10,577,680 B2
(45) **Date of Patent: *Mar. 3, 2020**

(54) FABRICABLE, HIGH STRENGTH, OXIDATION RESISTANT NI—CR—CO—MO—AL ALLOYS

(71) Applicant: Haynes International, Inc., Kokomo, IN (US)

(72) Inventors: S. Krishna Srivastava, Kokomo, IN (US); Lee Pike, Kokomo, IN (US)

(73) Assignee: Haynes International, Inc., Kokomo, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/454,913

(22) Filed: Jun. 27, 2019

(65) Prior Publication Data

US 2019/0323107 A1 Oct. 24, 2019

Related U.S. Application Data

(63) Continuation of application No. 15/956,138, filed on Apr. 18, 2018, now Pat. No. 10,358,699, which is a continuation of application No. 14/768,845, filed as application No. PCT/US2014/028224 on Mar. 14, 2014, now abandoned.

(60) Provisional application No. 61/790,137, filed on Mar. 15, 2013.

(51) Int. Cl.
*C22C 19/05* (2006.01)

(52) U.S. Cl.
CPC ..... *C22C 19/056* (2013.01)

(58) Field of Classification Search
CPC ..... C22C 19/056
See application file for complete search history.

(56) References Cited

U.S. PATENT DOCUMENTS

| | | | |
|---|---|---|---|
| 2,712,498 | A | 7/1955 | Gresham et al. |
| 2010/0166594 | A1 | 7/2010 | Hirata et al. |

FOREIGN PATENT DOCUMENTS

| | | | |
|---|---|---|---|
| CN | 101864531 | A | 10/2010 |
| DE | 102009010026 | A1 | 8/2010 |
| EP | 1502966 | A2 | 2/2005 |
| EP | 1640465 | A2 | 3/2006 |
| EP | 2511389 | A1 | 10/2012 |
| GB | 2105748 | A | 3/1983 |
| JP | 2009167500 | A | 7/2009 |
| JP | 2010065547 | A | 3/2010 |
| JP | 2011052308 | A | 3/2011 |
| RU | 2125110 | C1 | 1/1999 |
| RU | 2131944 | C1 | 6/1999 |
| UA | 29272 | U | 1/2008 |
| UA | 80319 | U | 5/2013 |
| UA | 80699 | U | 6/2013 |

OTHER PUBLICATIONS

International Search Report for PCT/US2014/028224 dated Nov. 19, 2014.

Written Opinion of the International Searching Authority for PCT/US2014/028224 dated Nov. 19, 2014.

"High-temperature oxidation performance of a new alumina-forming Ni—Fe—Cr—Al alloy in flowing air" International Journal of Hydrogen Energy 36 (2011) 4580-4587; V.P. Deodeshmukh, S.J. Matthews, D.L. Klarstrom.

"A Gleeble®-based Method for Ranking the Strain-Age Cracking Susceptibility of Ni-Based Superalloys" by D. A. Metzler; Supplement to the Welding Journal, Oct. 2008.

"Ranking the Resistance of Wrought Superalloys to Strain-Age Cracking" by M. D. Rowe; Supplement to the Welding Journal, Feb. 2006.

"Recent Sutdies of Cracking During Postwelding Heat Treatment of Nickel-Base Alloys" May 1970; Evaluating the Resistance of Rene 41 to Strain-Age Cracking, R. W. Fawley and M. Prager; Variables Influencing the Strain-Age Cracking and Mechanical Properties of Rene 41 and Related Alloys, J. B. Carlton and M. Prager; A Mechanism for Cracking During Postwelding Heat Treatment of Nickel-Base Alloys, M. Prager and G. Sines.

ASM International, Materials Park, Ohio, Properties and Selection: Nonferrous Alloys and Special Purpose Materials: "Rare Earth Metals", Oct. 1990, vol. 2, pp. 720-732.

*Primary Examiner* — Jessee R Roe
(74) *Attorney, Agent, or Firm* — Buchanan Ingersoll & Rooney PC

(57) ABSTRACT

Ni—Cr—Co—Mo—Al based alloys are disclosed which contain 15 to 20 wt. % chromium, 9.5 to 20 wt. % cobalt, 7.25 to 10 wt. % molybdenum, 2.72 to 3.89 wt. % aluminum, certain minor elemental additions, along with typical impurities, a tolerance for up to 10.5 wt. % iron, and a balance of nickel. These alloys are readily fabricable, have high creep strength, good thermal stability, and excellent oxidation resistance up to as high as 2100° F. (1149° C.). This combination of properties is useful for a variety of gas turbine engine components, including, for example, combustors.

25 Claims, 2 Drawing Sheets

FABRICABLE, HIGH STRENGTH, OXIDATION RESISTANT NI—CR—CO—MO—AL ALLOYS

CROSS-REFERENCE TO RELATED APPLICATIONS

This application is a continuation of U.S. patent application Ser. No. 15/956,138 which is a continuation of U.S. patent application Ser. No. 14/768,845, filed on Aug. 19, 2015, now abandoned, which is a national stage application of PCT/US2014/028224, filed on Mar. 14, 2014, which claims priority to U.S. Provisional Patent Application Ser. No. 61/790,137, filed on Mar. 15, 2013.

FIELD OF THE INVENTION

This invention relates to fabricable, high strength alloys for use at elevated temperatures. In particular, it is related to alloys which possess excellent oxidation resistance, high creep-rupture strength, and sufficient fabricability to allow for service in gas turbine engine combustors and other demanding high temperature environments.

BACKGROUND OF THE INVENTION

For sheet fabrications in gas turbine engines a variety of commercial alloys are available. These alloys can be divided into different families based on their key properties. Note that the following discussion relates to alloys which are cold fabricable/weldable, meaning that they can be produced as cold rolled sheet, cold formed into a fabricated part, and welded.

Gamma-Prime Formers.

These include R-41 alloy, Waspaloy alloy, 282® alloy, 263 alloy, and others. These alloys are characterized by their high creep-rupture strength. However, the maximum use temperatures of these alloys are limited by the gamma-prime solvus temperature and are generally not used above 1600-1700° F. (871 to 927° C.). Furthermore, while the oxidation resistance of these alloys is quite good in the use temperature range, at higher temperatures it is less so.

Alumina-Formers.

These include 214® alloy and HR-224® alloy, but not the ODS alloys (which do not have the requisite fabricability). The alloys in this family have excellent oxidation resistance at temperatures as high as 2100° F. (1149° C.). However, their use in structural components is limited due to poor creep strength at temperatures above around 1600-1700° F. (871 to 927° C.). Note that these alloys will also form the strengthening gamma-prime, but this phase is not stable in the higher temperature range.

Solid-Solution Strengthened Alloys.

These include 230® alloy, HASTELLOY® X alloy, 617 alloy, and others. As their name implies, these alloys derive their high creep-rupture strength primarily from the solid-solution strengthening effect, as well carbide formation. This strengthening remains effective even at very high temperatures—well above the maximum temperature of the gamma-prime formers, for example. Most of the solid-solution strengthened alloys have very good oxidation resistance due to the formation of a protective chromia scale. However, their oxidation resistance is not comparable to the alumina-formers, particularly at the very high temperatures, such as 2100° F. (1149° C.).

Nitride Dispersion Strengthened Alloys.

These include NS-163® alloy which has very high creep-rupture strength at temperatures as high as 2100° F. (1149° C.). While the creep-rupture strength of NS-163 alloy is better than the solid-solution alloys, its oxidation resistance is only similar. It does not have the excellent oxidation resistance of the alumina-formers.

What is clear from the above discussion is that there is no cold fabricable/weldable alloy commercially available which combines both high creep-rupture strength and excellent oxidation resistance. However, in the effort to continually push gas turbine engine operating temperatures higher and higher, it is clear that alloys which combine these qualities would be very desirable.

SUMMARY OF THE INVENTION

The principal object of this invention is to provide readily fabricable alloys which possess both high creep-rupture strength and excellent oxidation-resistance. This is a highly valuable combination of properties not found in (or expected from) the prior art. The composition of alloys which have been discovered to possess these properties is: 15 to 20 wt. % chromium (Cr), 9.5 to 20 wt. % cobalt (Co), 7.25 to 10 wt. % molybdenum (Mo), 2.72 to 3.89 wt. % aluminum (Al), silicon (Si) present up to 0.6 wt. %, and carbon (C) present up to 0.15 wt. %. Titanium is present at a minimum level of 0.02 wt. %, but a level greater than 0.2% is preferred. Niobium (Nb) may be also present to provide strengthening, but is not necessary to achieve the desired properties. An overabundance of Ti and/or Nb may increase the propensity of an alloy for strain-age cracking. Titanium should be limited to no more than 0.75 wt. %, and niobium to no more than 1 wt. %.

The presence of the elements hafnium (Hf) and/or tantalum (Ta) has unexpectedly been found to be associated with even greater creep-rupture lives in these alloys. Therefore, one or both elements may be added to these alloys to further improve creep-rupture strength. Hafnium may be added at levels up to around 1 wt. %, while tantalum may be added at levels up to around 1.5 wt. %. To be most effective, the sum of the tantalum and hafnium contents should be greater than 0.2 wt. %, but not more than 1.5 wt. %. Between the two elements Ta is preferred over Hf as the oxidation resistance of Hf-containing alloys was found to be inferior to Ta-containing alloys.

To maintain fabricability, certain required elements (Al, Ti) and, if present, certain optional elements (Ta, Nb) should be limited in total quantity in a manner to satisfy the following additional relationship (where elemental quantities are in wt. %):

$$Al+0.56Ti+0.29Nb+0.15Ta\leq 3.9 \quad [1]$$

Additionally, boron (B) may be present in a small, but effective trace content up to 0.015 wt. % to obtain certain benefits known in the art. Tungsten (W) may be present in this alloy up to around 2 wt. %. Iron (Fe) may also be present as an impurity, or may be an intentional addition to lower the overall cost of raw materials. However, iron should not be present more than around 10.5 wt. %. If niobium and/or tungsten are present as minor element additions, the iron content should be further limited to 5 wt. % or less. To enable the removal of oxygen (O) and sulfur (S) during the melting process, these alloys typically contain small quantities of manganese (Mn) up to about 1 wt. %, and silicon (Si) up to around 0.6 wt. %, and possibly traces of magnesium (Mg), calcium (Ca), and rare earth elements (including yttrium (Y), cerium (Ce), lanthanum (La), etc.) up to about 0.05 wt. % each. Zirconium (Zr) may be present in the alloy, but should be kept to less than 0.06 wt. % in these alloys to maintain fabricability.

DESCRIPTION OF THE PREFERRED EMBODIMENTS

Figure 1:
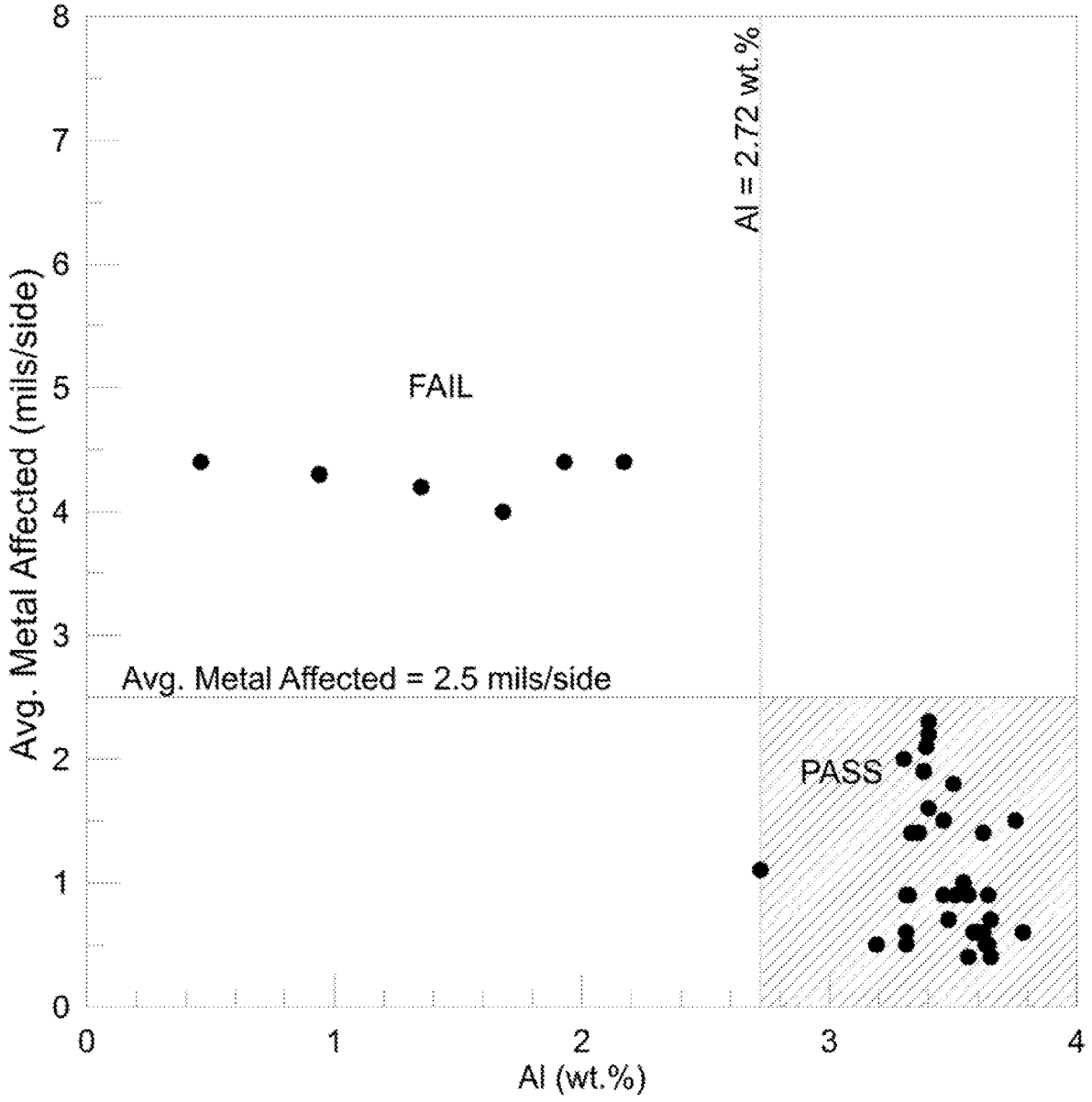
FIG. 1 is a graph of the oxidation resistance of several experimental Ni—Cr—Co—Mo—Al alloys plotted against the Al content of the alloy.

We provide Ni—Cr—Co—Mo—Al based alloys which contain 15 to 20 wt. % chromium, 9.5 to 20 wt. % cobalt, 7.25 to 10 wt. % molybdenum, 2.72 to 3.89 wt. % aluminum, certain minor element additions, along with typical impurities, a tolerance for up to 10.5 wt. % iron, and a balance of nickel, which are readily fabricable, have high creep strength, and excellent oxidation resistance up to as high as 2100° F. (1149° C.). This combination of properties is useful for a variety of gas turbine engine components, including, for example, combustors.

Based on the understanding of the requirements of future gas turbine engine combustors, an alloy with the following attributes would be highly desirable: 1) excellent oxidation resistance at temperatures as high as 2100° F. (1149° C.), 2) good fabricability, such that it can be produced in wrought sheet form, cold formed, welded, etc., 3) high temperature creep-strength as good or better than common commercial alloys, such as HASTELLOY X alloy, and 4) good thermal stability at elevated temperatures. Historically, attempts to develop an alloy combining all four properties have not been successful, and correspondingly, no commercial alloy is available in the marketplace with all four of these qualities.

We tested 50 experimental alloys whose compositions are set forth in Table 1. The experimental alloys have been labeled A through Z and AA through XX. The experimental alloys had a Cr content which ranged from 15.3 to 19.9 wt. %, as well as a cobalt content ranging from 9.7 to 20.0 wt. %. The molybdenum content ranged from 5.2 to 12.3 wt. %. The aluminum content ranged from 0.46 to 4.63 wt. %. Iron was present in most of the alloys from 1 up to 10.4 wt. %, however, in one alloy iron was not added at all (alloy R) and was not detected in the chemical analysis. Titanium was present in all of the alloys and ranged from 0.02 to 0.56 wt. %. Silicon was present from 0.13 to 0.51 wt. %. Minor elemental quantities of niobium, tantalum, hafnium, tungsten, yttrium, zirconium, carbon, and boron were present in certain experimental alloys.

All testing of the alloys was performed on sheet material of 0.065" to 0.125" (1.6 to 3.2 mm) thickness. The experimental alloys were vacuum induction melted, and then electro-slag remelted, at a heat size of 30 to 50 lb. (13.6 to 27.2 kg). The ingots so produced were hot forged and rolled to intermediate gauge. The sheets were annealed, water quenched, and cold rolled to produce sheets of the desired gauge. Intermediate annealing of cold rolled sheet was necessary during production of the 0.065" sheet (1.6 mm). The cold rolled sheets were annealed as necessary to produce a fully recrystallized, equiaxed grain structure with an ASTM grain size between 3½ and 4½. The sheet samples were water quenched after annealing.

TABLE 1

Compositions of Experimental Alloys (in wt. %)

| Alloy | Ni | Cr | Co | Mo | Al | Fe | C | Si | Mn | Ti | Y | Zr | B | Other |
|---|---|---|---|---|---|---|---|---|---|---|---|---|---|---|
| A | Bal. | 19.9 | 14.8 | 7.8 | 3.64 | 1.2 | 0.096 | 0.15 | — | 0.25 | 0.02 | 0.04 | 0.004 | |
| B | Bal. | 19.8 | 10.1 | 7.7 | 3.56 | 1.3 | 0.088 | 0.14 | — | 0.25 | 0.02 | 0.04 | 0.004 | |
| C | Bal. | 16.1 | 19.9 | 7.6 | 3.65 | 1.3 | 0.099 | 0.14 | — | 0.24 | 0.02 | 0.04 | 0.004 | |
| D | Bal. | 16.1 | 19.9 | 7.7 | 3.54 | 5.2 | 0.079 | 0.14 | — | 0.25 | 0.02 | 0.02 | 0.004 | |
| E | Bal. | 16.0 | 19.8 | 7.7 | 3.62 | 9.7 | 0.085 | 0.14 | — | 0.25 | 0.02 | 0.01 | 0.004 | |
| F | Bal. | 16.0 | 10.1 | 7.7 | 3.46 | 1.2 | 0.097 | 0.14 | — | 0.22 | 0.01 | 0.02 | 0.004 | |
| G | Bal. | 16.1 | 9.9 | 7.8 | 3.51 | 9.9 | 0.089 | 0.13 | — | 0.23 | 0.01 | 0.02 | 0.005 | |
| H | Bal. | 16.0 | 19.7 | 9.5 | 3.56 | 1.2 | 0.107 | 0.17 | — | 0.24 | — | 0.02 | 0.005 | |
| I | Bal. | 15.8 | 19.3 | 7.5 | 3.60 | 1.0 | 0.110 | 0.18 | — | 0.23 | 0.02 | 0.02 | 0.004 | 1.94 W |
| J | Bal. | 16.0 | 9.8 | 9.5 | 3.58 | 9.9 | 0.116 | 0.17 | — | 0.22 | 0.02 | 0.01 | 0.005 | |
| K | Bal. | 16.3 | 19.3 | 7.5 | 3.50 | 1.1 | 0.104 | 0.14 | — | 0.22 | 0.02 | 0.04 | 0.004 | 0.43 Hf |
| L | Bal. | 16.2 | 20.0 | 7.8 | 3.48 | 1.0 | 0.106 | 0.22 | — | 0.23 | 0.02 | 0.02 | 0.005 | 0.71 Ta |
| M | Bal. | 16.6 | 10.1 | 7.7 | 3.75 | 10.4 | 0.108 | 0.15 | — | 0.23 | 0.02 | 0.03 | 0.004 | 0.38 Hf |
| N | Bal. | 16.7 | 10.2 | 7.8 | 3.64 | 10.2 | 0.110 | 0.19 | — | 0.23 | 0.02 | 0.02 | 0.005 | 0.78 Ta |
| O | Bal. | 16.0 | 19.9 | 7.5 | 3.60 | 1.1 | 0.107 | 0.17 | — | 0.23 | 0.02 | 0.02 | 0.004 | 0.35 Nb, 0.69 Ta |
| P | Bal. | 16.0 | 9.9 | 7.5 | 3.63 | 10.0 | 0.107 | 0.19 | — | 0.23 | 0.02 | 0.02 | 0.004 | 1.93 W |
| Q | Bal. | 16.2 | 10.1 | 7.6 | 3.65 | 10.2 | 0.112 | 0.18 | — | 0.22 | 0.02 | 0.02 | 0.005 | 0.35 Nb, 0.71 Ta |
| R | Bal. | 15.3 | 20 | 10.0 | 3.32 | — | 0.114 | 0.19 | 0.20 | 0.22 | 0.01 | 0.04 | 0.004 | |
| S | Bal. | 15.9 | 9.9 | 9.5 | 3.78 | 1.0 | 0.107 | 0.47 | 0.19 | 0.02 | 0.011 | 0.04 | 0.004 | |
| T | Bal. | 16.0 | 9.9 | 7.6 | 2.72 | 4.5 | 0.120 | 0.17 | 0.20 | 0.22 | 0.015 | 0.04 | 0.004 | 1.89 W, 0.91 |
| U | Bal. | 19.5 | 19.9 | 7.6 | 3.36 | 1.1 | 0.103 | 0.17 | 0.20 | 0.49 | 0.013 | 0.04 | 0.005 | |
| V | Bal. | 19.0 | 9.9 | 8.0 | 3.40 | 1.0 | 0.090 | 0.18 | 0.15 | 0.21 | 0.011 | 0.04 | 0.005 | 0.48 Hf |
| W | Bal. | 18.9 | 19.9 | 7.5 | 3.31 | 1.0 | 0.086 | 0.18 | 0.14 | 0.21 | 0.009 | 0.03 | 0.004 | 1.0 Ta |
| X | Bal. | 19.2 | 19.9 | 7.7 | 3.40 | 1.0 | 0.088 | 0.17 | 0.13 | 0.21 | 0.011 | 0.04 | 0.004 | 0.45 Hf |
| Y | Bal. | 16.4 | 10.2 | 7.8 | 2.81 | 1.1 | 0.108 | 0.49 | 0.50 | 0.22 | 0.010 | 0.04 | 0.004 | |
| Z | Bal. | 19.0 | 10 | 7.4 | 3.19 | 1.0 | 0.091 | 0.18 | 0.16 | 0.21 | 0.008 | 0.03 | 0.004 | 1.0 Ta |
| AA | Bal. | 19.2 | 20 | 5.2 | 3.37 | 1.0 | 0.107 | 0.18 | 0.20 | 0.24 | 0.012 | 0.04 | 0.004 | |
| BB | Bal. | 19.3 | 20 | 12.3 | 3.67 | 1.0 | 0.099 | 0.51 | 0.53 | 0.42 | 0.011 | 0.04 | 0.004 | |
| CC | Bal. | 19.4 | 10 | 9.6 | 1.93 | 1.0 | 0.107 | 0.19 | 0.21 | 0.24 | — | — | 0.004 | |
| DD | Bal. | 18.9 | 10 | 9.5 | 4.30 | 1.0 | 0.117 | 0.49 | 0.21 | 0.43 | 0.005 | 0.05 | 0.004 | |
| EE | Bal. | 18.6 | 9.8 | 7.6 | 3.31 | 1.0 | 0.086 | 0.18 | 0.15 | 0.21 | 0.008 | 0.04 | 0.004 | 1.0 Nb |
| FF | Bal. | 19.0 | 9.9 | 7.4 | 3.38 | 1.1 | 0.102 | 0.18 | 0.20 | 0.22 | 0.016 | 0.06 | 0.004 | 0.34 Hf, 0.51 Ta |
| GG | Bal. | 18.9 | 20 | 7.6 | 3.33 | 1.1 | 0.108 | 0.19 | 0.21 | 0.54 | 0.013 | 0.04 | 0.005 | 0.51 Ta |

TABLE 1-continued

Compositions of Experimental Alloys (in wt. %)

| Alloy | Ni | Cr | Co | Mo | Al | Fe | C | Si | Mn | Ti | Y | Zr | B | Other |
|---|---|---|---|---|---|---|---|---|---|---|---|---|---|---|
| HH | Bal. | 19.0 | 19.1 | 7.5 | 3.40 | 1.0 | 0.106 | 0.18 | 0.21 | 0.48 | 0.008 | 0.04 | 0.003 | 0.26 Hf, 0.22 Ta |
| II | Bal. | 18.9 | 19.1 | 7.8 | 3.46 | 1.1 | 0.109 | 0.18 | 0.22 | 0.27 | 0.009 | 0.04 | 0.004 | 0.26 Hf, 0.48 Ta |
| JJ | Bal. | 18.8 | 18.9 | 7.5 | 3.39 | 1.1 | 0.100 | 0.20 | 0.22 | 0.27 | 0.013 | 0.03 | 0.004 | 0.52 Nb, 0.48 Ta |
| KK | Bal. | 18.9 | 19.1 | 7.4 | 3.31 | 1.1 | 0.107 | 0.21 | 0.22 | 0.56 | 0.007 | 0.03 | 0.004 | 0.28 Nb, 0.25 Ta |
| LL | Bal. | 18.8 | 10.9 | 7.4 | 3.30 | 1.2 | 0.107 | 0.23 | 0.25 | 0.55 | 0.007 | 0.04 | 0.003 | 0.27 Nb, 0.25 Ta |
| MM | Bal. | 19.2 | 10.1 | 7.8 | 3.62 | 1.1 | 0.110 | 0.21 | 0.21 | 0.53 | 0.012 | 0.04 | 0.005 | 0.55 Ta |
| NN | Bal. | 19.0 | 19.1 | 7.5 | 3.38 | 1.0 | 0.103 | 0.29 | 0.03 | 0.54 | 0.002 | 0.03 | 0.002 | 0.45 Ta |
| OO | Bal. | 18.1 | 12.1 | 8.0 | 2.17 | 1.0 | 0.107 | 0.22 | 0.21 | 0.27 | 0.006 | 0.03 | 0.004 | |
| PP | Bal. | 18.1 | 12.1 | 7.8 | 1.68 | 1.1 | 0.107 | 0.20 | 0.22 | 0.26 | 0.003 | 0.03 | 0.005 | |
| QQ | Bal. | 17.9 | 12.3 | 7.5 | 1.35 | 1.1 | 0.104 | 0.20 | 0.21 | 0.26 | 0.003 | 0.03 | 0.004 | |
| RR | Bal. | 17.9 | 12.1 | 7.8 | 0.94 | 1.0 | 0.096 | 0.21 | 0.21 | 0.27 | 0.004 | 0.02 | 0.004 | |
| SS | Bal. | 17.9 | 11.9 | 7.8 | 0.46 | 1.0 | 0.107 | 0.21 | 0.21 | 0.23 | 0.003 | 0.02 | 0.003 | |
| TT | Bal. | 18.0 | 11.8 | 8.0 | 3.96 | 1.0 | 0.110 | 0.22 | 0.21 | 0.26 | 0.004 | 0.04 | 0.004 | |
| UU | Bal. | 18.0 | 11.9 | 8.1 | 4.04 | 1.0 | 0.108 | 0.22 | 0.22 | 0.26 | 0.005 | 0.04 | 0.004 | |
| VV | Bal. | 17.8 | 11.9 | 7.9 | 4.32 | 1.0 | 0.107 | 0.20 | 0.22 | 0.26 | 0.003 | 0.04 | 0.004 | |
| WW | Bal. | 17.7 | 12.1 | 7.9 | 4.41 | 1.0 | 0.110 | 0.20 | 0.22 | 0.26 | 0.005 | 0.04 | 0.004 | |
| XX | Bal. | 17.7 | 12.1 | 8.0 | 4.63 | 1.0 | 0.104 | 0.20 | 0.22 | 0.25 | 0.006 | 0.04 | 0.004 | |

To evaluate the key properties (oxidation resistance, fabricability, creep strength, and thermal stability) four different types of tests were performed on experimental alloys to establish their suitability for the intended applications. The results of these tests are described in the following sections. Additionally, limited key property testing was performed on seven commercially available alloys to provide comparative information. Table 2 provides the measured compositions of samples of the tested commercial alloys for background along with the UNS compositional limits for the alloys. Note that the sample chemistries for the commercial alloys were taken from actual samples of the commercial alloys and are considered representative, but may not correspond to the same heat(s) tested in this program.

TABLE 2

Compositions of Commercial Alloys

| | | Waspaloy | R-41 | 263 | 230 | 617 | HASTELLOY X | 214 |
|---|---|---|---|---|---|---|---|---|
| Ni | — | Bal. | Bal. | Bal. | Bal. | Bal. | Bal. | Bal. |
| Cr | Sample | 19.1 | 19.4 | 20 | 22 | 22 | 21 | 16 |
| | Min | 18.00 | 18.00 | 19.0 | 20.0 | 20.0 | 20.5 | 15.0 |
| | Max | 21.00 | 20.00 | 21.0 | 24.0 | 24.0 | 23.0 | 17.0 |
| Co | Sample | 13.8 | 11.7 | 20 | 0.1 | 13 | 1 | — |
| | Min | 12.00 | 10.00 | 19.0 | 0 | 10.0 | 0.5 | 0 |
| | Max | 15.00 | 12.00 | 21.0 | 5.0 | 15.0 | 2.5 | 2.0 |
| Mo | Sample | 4.6 | 9.8 | 5.9 | 1.2 | 9.6 | 0.2 | — |
| | Min | 3.50 | 9.00 | 5.60 | 1.0 | 8.00 | 8.0 | 0 |
| | Max | 5.00 | 10.50 | 6.10 | 3.0 | 10.00 | 10.0 | 0.5 |
| Al | Sample | 1.36 | 1.49 | 0.43 | 0.29 | 1.16 | 0.19 | 4.37 |
| | Min | 1.20 | 1.40 | 0.3 | 0.20 | 0.8 | — | 4.0 |
| | Max | 1.60 | 1.80 | 0.6 | 0.50 | 1.5 | — | 5.0 |
| Fe | Sample | 1.7 | 3.8 | 0.4 | 1.1 | 1.2 | 19 | 3.5 |
| | Min | 0 | 0 | 0 | 0 | 0 | 17.0 | 2.0 |
| | Max | 2.00 | 5.00 | 0.7 | 3.0 | 3.00 | 20.0 | 4.0 |
| C | Sample | 0.08 | 0.10 | 0.06 | 0.10 | 0.08 | 0.07 | 0.03 |
| | Min | 0.03 | 0 | 0.04 | 0.05 | 0.05 | 0.05 | 0 |
| | Max | 0.10 | 0.12 | 0.08 | 0.15 | 0.15 | 0.15 | 0.05 |
| Si | Sample | 0.07 | 0.08 | 0.11 | 0.36 | 0.08 | 0.46 | 0.05 |
| | Min | 0 | 0 | 0 | 0.25 | 0 | 0 | 0 |
| | Max | 0.75 | 0.50 | 0.40 | 0.75 | 1.00 | 1.00 | 0.2 |
| Mn | Sample | 0.02 | 0.02 | 0.19 | 0.47 | 0.06 | 0.65 | 0.19 |
| | Min | 0 | 0 | 0 | 0.30 | 0 | 0 | 0 |
| | Max | 1.00 | 0.10 | 0.60 | 1.00 | 1.00 | 1.00 | 0.5 |
| Ti | Sample | 2.9 | 3.0 | 2.1 | — | 0.4 | — | — |
| | Min | 2.75 | 3.00 | 1.9 | 0 | 0 | — | 0 |
| | Max | 3.25 | 3.30 | 2.4 | 0.10 | 0.60 | — | 0.5 |
| B | Sample | 0.006 | 0.007 | — | 0.004 | 0.003 | — | 0.002 |
| | Min | 0.003 | 0.003 | — | 0 | 0 | — | 0 |
| | Max | 0.01 | 0.010 | — | 0.015 | 0.006 | — | 0.006 |
| W | Sample | — | — | — | 13.8 | — | 0.6 | — |
| | Min | — | — | — | 13.0 | — | 0.20 | — |
| | Max | — | — | — | 15.0 | — | 1.0 | 0.5 |
| Zr | Sample | 0.03 | — | — | — | — | — | 0.04 |
| | Min | 0.02 | — | — | — | — | — | 0 |
| | Max | 0.12 | — | — | — | — | — | 0.05 |

Oxidation Resistance

Oxidation resistance is a key property for an advanced high temperature alloy. Temperatures in the combustor of a gas turbine engine can be very high and there is always a push in the industry for higher and higher use temperatures. An alloy having excellent oxidation resistance at as high as 2100° F. (1149° C.) would be a good candidate for a number of applications. The oxidation resistance of nickel-base alloys is strongly affected by the nature of the oxides which form on the surface of the alloy upon thermal exposure. It is generally favorable to form a protective surface layer, such as chromium-rich and aluminum-rich oxides. Alloys which form such oxides are often referred to as chromia or alumina formers, respectively. The vast majority of wrought high temperature nickel alloys are chromia formers. However, a few alumina-formers are commercially available. One such example is HAYNES® 214® alloy. The 214 alloy is well known for its excellent oxidation resistance.

For the purpose of determining the oxidation resistance of the experimental alloys, oxidation testing was conducted on most of the alloys in flowing air at 2100° F. (1149° C.) for 1008 hours. Also tested alongside these samples were five commercial alloys: HAYNES 214 alloy, 617 alloy, 230 alloy, 263 alloy, and HASTELLOY X alloy. Samples were cycled to room temperature weekly. At the conclusion of the 1008 hours the samples were descaled and submitted for metallographic examination. Recorded in Table 3 are the results of the oxidation tests. The recorded value is the average metal affected, which is the sum of the metal loss plus the average internal penetration of the oxidation attack. Details of this type of testing can be found in *International Journal of Hydrogen Energy*, Vol. 36, 2011, pp. 4580-4587. For the purposes of this invention, an average metal affected value of 2.5 mils/side (64 μm/side) or less was the preferred objective and an appropriate indication of whether a given alloy could be considered as having "excellent" oxidation resistance. Indeed, metallographic examination of the alloys with less than this level of attack confirm their desirable oxidation behavior. Certain minor elements/impurities could possibly result in somewhat reduced (but still acceptable) oxidation resistance, therefore the average metal affected value could probably be as high as 3 mils/side (76 μm/side) while still maintaining excellent oxidation resistance.

TABLE 3

2100° F. (1149° C.) Oxidation Test Results

| Alloy | Average Metal Affected (mils/side) | Average Metal Affected (μm/side) |
|---|---|---|
| A | 0.9 | 23 |
| B | 0.9 | 23 |
| C | 0.7 | 18 |
| D | 1.0 | 25 |
| E | 0.6 | 15 |
| F | 0.9 | 23 |
| G | 0.9 | 23 |
| H | 0.4 | 10 |
| I | 0.6 | 15 |
| J | 0.6 | 15 |
| K | 1.8 | 46 |
| L | 0.7 | 18 |
| M | 1.5 | 38 |
| N | 0.5 | 13 |
| O | 0.6 | 15 |
| P | 0.5 | 13 |
| Q | 0.4 | 10 |
| R | 0.9 | 23 |
| S | 0.6 | 15 |
| T | 1.1 | 28 |
| U | 1.4 | 36 |
| V | 2.3 | 58 |
| W | 0.5 | 13 |
| X | 1.6 | 41 |
| Z | 0.5 | 13 |
| CC | 4.4 | 112 |
| EE | 0.6 | 15 |
| FF | 1.9 | 48 |
| GG | 1.4 | 36 |
| HH | 2.2 | 56 |
| II | 1.5 | 38 |
| JJ | 2.1 | 53 |
| KK | 0.9 | 23 |
| LL | 2.0 | 51 |
| MM | 1.4 | 36 |
| OO | 4.4 | 112 |
| PP | 4.0 | 102 |
| QQ | 4.2 | 107 |
| RR | 4.3 | 109 |
| SS | 4.4 | 112 |
| 263 | 16.5 | 419 |
| 214 | 1.3 | 33 |
| 617 | 5.1 | 130 |
| 230 | 4.8 | 122 |
| HASTELLOY X | 12.0 | 305 |

The results of the oxidation testing of the experimental alloys were very impressive. Most of the tested experimental alloys had excellent oxidation resistance with an average metal affected of 2.3 mils/side (58 μm) or less. Therefore, all of these alloys had acceptable oxidation resistance for the purposes of this invention. The exceptions were the 6 alloys CC, OO, PP, QQ, RR, and SS which had oxidation attack greater than acceptable for this invention. These 6 alloys had compositions outside of those of the present invention. Considering the commercial alloys, the acceptable experimental alloys were all comparable to the alumina-forming HAYNES 214 alloy, which had an average metal affected value of 1.3 mils/side (33 μm). In contrast, the chromia-forming 617 alloy, 230 alloy, HASTELLOY X alloy, and 263 alloy all had much higher levels of oxidation attack, with average metal affected values of 5.1, 4.8, 12.0, and 16.5 mils/side (130, 122, 305, and 419 μm), respectively. The excellent oxidation resistance of the acceptable experimental alloys is believed to derive from a critical amount of aluminum, which was 2.72 wt. % or greater for all of the experimental alloys other than alloys CC, OO, PP, QQ, RR, and SS. These 6 alloys had Al values ranging from 0.46 to 2.17 wt. % which is below the critical value of 2.72 wt. % required by this invention. Similarly, the Al levels of the four chromia-forming commercial alloys were quite low (the highest being 617 alloy with 1.2 wt. % Al). In contrast, the alumina forming 214 alloy has an Al content of 4.5 wt. %. In summary, all of the nickel-base alloys tested in this program with an Al level of 2.72 wt. % or greater were found to have excellent oxidation resistance, while those with lower Al levels did not. Therefore, to be considered an alloy of the present invention the Al level of the alloy should be greater than or equal to 2.72 wt. %.

Fabricability

One of the requirements of the alloys of this invention is that they are fabricable. As discussed previously, for alloys containing significant amounts of certain elements (such as aluminum, titanium, niobium, and tantalum), having good fabricability is closely tied to the alloy's resistance to strain-age cracking. The resistance of the experimental alloys to strain-age cracking was measured using the modified CHRT test described by Metzler in *Welding Journal* supplement, October 2008, pp. 249s-256s. This test was developed to determine an alloy's relative resistance to strain-age cracking. It is a variation of the test described in U.S. Pat. No. 8,066,938 and in the paper by Rowe in *Welding Journal* supplement, February 2006, pp. 27s-34s. The CHRT test was originally developed in the late 1960's as a method to determine the susceptibility of various heats of Rene 41 (R-41) alloy to strain-age cracking (Fawley, R. W., Prager, M., Carlton, J. B., and Sines, G. 1970, *WRC Bulletin* No. 150. Welding Research Council, NY). In the CHRT test, a solution annealed tension-test specimen is heated at a controlled rate to a test temperature in the gamma-prime precipitation temperature range, then pulled to failure. The elongation is indicative of an alloy's resistance to strain-age cracking/fabricability. The CHRT test is conducted on a sample starting in the annealed condition. During the test itself, the sample undergoes gamma-prime precipitation that simulates the effect of welding and consequent cooling. The CHRT test thus reliably predicts the behavior of the material in the welded condition. The CHRT test was designed to be a relatively simple test to perform but the results agree well with reported strain-age cracking studies (for example, see Rowe in *Welding Journal* supplement, February 2006, pp. 27s-34s). Key variables found to affect performance in the CHRT test include composition and grain size.

In the modified CHRT test, the width of the gauge section is variable and the test is performed on a dynamic thermo-mechanical simulator rather than a screw-driven tensile unit. The results of the two different forms of the test are expected to be qualitatively similar, but the absolute quantitative results will be different. The results of the modified CHRT testing performed on our experimental alloys are shown in Table 4. The testing was conducted at 1450° F. (788° C.), and the reported CHRT ductility values were measured as elongation over 1.5 inches (38 mm). The modified CHRT test ductility of the experimental alloys ranged from 4.2% for alloy WW to 17.9% for alloy X.

Also shown in Table 4 are the modified CHRT test results for three commercial alloys as published by Metzler in *Welding Journal* supplement, October 2008, pp. 249s-256s. The modified CHRT test ductility values for R-41 alloy and Waspaloy were both less than 7%, while the value for 263 alloy was 18.9%. The R-41 alloy and Waspaloy alloy, while weldable, are both known to be susceptible to strain-age cracking, whereas 263 alloy is considered readily weldable. For this reason, alloys of the present invention should possess modified CHRT test ductility values greater than 7%. Of the experimental alloys tested only alloys O, DD, MM, TT, UU, VV, WW, and XX had a modified CHRT test ductility value less than 7%; therefore, these 8 alloys cannot be considered alloys of the present invention.

TABLE 4

Results of the Modified CHRT test

| Alloy | Modified CHRT Test Ductility (%) |
|---|---|
| A | 13.0 |
| B | 11.6 |
| C | 7.7 |
| D | 13.3 |
| E | 13.6 |
| F | 8.9 |

TABLE 4-continued

Results of the Modified CHRT test

| Alloy | Modified CHRT Test Ductility (%) |
|---|---|
| G | 10.3 |
| H | 8.7 |
| I | 9.4 |
| J | 10.2 |
| K | 8.6 |
| L | 8.0 |
| M | 9.7 |
| N | 10.0 |
| O | 6.3 |
| P | 9.3 |
| Q | 10.2 |
| R | 10.8 |
| S | 9.4 |
| T | 9.9 |
| U | 9.5 |
| V | 15.1 |
| W | 16.3 |
| X | 17.9 |
| Y | 13.5 |
| Z | 11.9 |
| AA | 10.5 |
| BB | 8.9 |
| CC | 15.3 |
| DD | 5.9 |
| EE | 10.1 |
| FF | 11.7 |
| GG | 9.3 |
| HH | 10.9 |
| II | 12.8 |
| JJ | 10.5 |
| KK | 10.8 |
| LL | 10.5 |
| MM | 6.7 |
| TT | 6.0 |
| UU | 5.8 |
| VV | 5.4 |
| WW | 4.2 |
| XX | 4.4 |
| R-41 | 6.9 |
| Waspaloy | 6.8 |
| 263 | 18.9 |

It was discovered that for these Ni—Cr—Co—Mo—Al based alloys, the resistance to strain age cracking could be associated with the total amount of the gamma-prime forming elements Al, Ti, Nb, and Ta. Therefore, the combined amount of these elements present in the alloy should satisfy the following relationship (where the elemental quantities are given in weight %):

$$Al+0.56Ti+0.29Nb+0.15Ta \leq 3.9 \quad [1]$$

While this empirical relationship was found for alloys based on the Ni—Cr—Co—Mo—Al system, it is understood that it should only apply to alloys in the compositional "neighborhood" of the experimental alloys tested here. If a certain alloy had a different compositional base, for example like commercial alloys HAYNES® 282® alloy (Ni—Cr—Co—Mo—Ti—Al base), HAYNES 214® alloy (Ni—Cr—Al—Fe base), or HAYNES X-750 (Ni—Cr—Fe—Ti—Nb—Al base), simply satisfying Equation 1 would not necessarily ensure good resistance to strain-age cracking. However, for the Ni—Cr—Co—Mo—Al alloys of concern in the present invention Equation 1 is very useful.

The values of the left-hand side of Equation 1 are shown in Table 5 for all of the experimental alloys. All alloys where Al+0.56Ti+0.29Nb+0.15Ta was less than or equal to 3.9 were found to have greater than 7% modified CHRT test ductility and therefore pass the strain-age cracking resistance requirement of the present invention. Only alloys O, Q, DD, MM, TT, UU, VV, WW, and XX were found to have values greater than 3.9. For alloys O, DD, MM, TT, UU, VV, WW, and XX, the high values in Table 5 can be correlated with poor modified CHRT test ductility. On the other hand, alloy Q was found to have acceptable modified CHRT test ductility. It is believed that this is a result of the alloy's high Fe content. Fe additions are known to suppress the formation of gamma-prime and could therefore help to improve the modified CHRT test ductility. Nevertheless, a lower amount of gamma-prime forming elements is generally beneficial for fabricability. Therefore, the value of Al+0.56Ti+0.29Nb+0.15Ta should be kept to less than or equal to 3.9 for all alloys of the present invention. Note that one implication of Equation 1 is that the maximum aluminum content of the alloys of this invention must be 3.89 wt. %—which corresponds to the case where titanium is at the lowest allowed by the invention (0.02 wt. %) and niobium, and tantalum are both absent.

TABLE 5

Experimental Alloys - Eq. [1] value (left-hand side)

| Alloy | Al + 0.56 Ti + 0.29 Nb + 0.15 Ta |
|---|---|
| A | 3.78 |
| B | 3.70 |
| C | 3.78 |
| D | 3.68 |
| E | 3.76 |
| F | 3.58 |
| G | 3.64 |
| H | 3.69 |
| I | 3.73 |
| J | 3.70 |
| K | 3.62 |
| L | 3.72 |
| M | 3.88 |
| N | 3.89 |
| O | 3.93 |
| P | 3.76 |
| Q | 3.98 |
| R | 3.44 |
| S | 3.79 |
| T | 3.11 |
| U | 3.63 |
| V | 3.52 |
| W | 3.58 |
| X | 3.52 |
| Y | 2.93 |
| Z | 3.46 |
| AA | 3.50 |
| BB | 3.90 |
| CC | 2.06 |
| DD | 4.54 |
| EE | 3.72 |
| FF | 3.58 |
| GG | 3.71 |
| HH | 3.70 |
| II | 3.68 |
| JJ | 3.76 |
| KK | 3.74 |
| LL | 3.72 |
| MM | 4.00 |
| NN | 3.75 |
| OO | 2.32 |
| PP | 1.83 |
| QQ | 1.50 |
| RR | 1.09 |
| SS | 0.59 |
| TT | 4.11 |
| UU | 4.19 |
| VV | 4.47 |
| WW | 4.56 |
| XX | 4.77 |

Creep-Rupture Strength

The creep-rupture strength of the experimental alloys was determined using a creep-rupture test at 1800° F. (982° C.) under a load of 2.5 ksi (17 MPa). Under these conditions, the creep-resistant HASTELLOY X alloy is estimated (based on interpolated data from Haynes International, Inc. publication # H-3009C) to have a creep-rupture life of 285 hours. For the purposes of this invention, a minimum creep-rupture life of 325 hours was established as the requirement, which would be a marked improvement over HASTELLOY X alloy. It is useful to note that the test temperature of 1800° F. (982° C.) is greater than the predicted gamma-prime solvus temperature of the experimental alloys, thus any effects of gamma-prime phase strengthening should be negligible.

The creep-rupture life of the experimental alloys is shown in Table 6 along with those of several commercial alloys. Note that in some cases the test was interrupted at a point beyond the 325 hour mark rather than continued to the rupture point; in those cases the creep-rupture life is reported as a "greater than" value. Alloys A through O, R through Z, BB, and EE through NN were all found to have creep-rupture lives greater than 325 hours under these conditions, and therefore meet the creep-rupture requirement of the present invention. Alloys P, Q, AA, CC and DD were found to fail the creep-rupture requirement. Considering the commercial alloys, 617 alloy and 230 alloy had acceptable creep-rupture lives of 732.2 and 915.4 hours, respectively. Conversely, the 214 alloy had a creep-rupture life of only 196.0 hours—well below that of the creep-rupture life requirement which defines alloys of the present invention.

TABLE 6

Creep-Rupture Life at 1800° F. (982° C.)/2.5 ksi (17 MPa)

| Alloy | Rupture Life (hours) |
|---|---|
| A | 1076.7 |
| B | 534.7 |
| C | 486.1 |
| D | 447.0 |
| E | 331.9 |
| F | 402.8 |
| G | 722.0 |
| H | 2051.1 |
| I | 360.0 |
| J | 1785.7 |
| K | 5645.5 |
| L | 566.7 |
| M | 1317.4 |
| N | 1197.3 |
| O | 340.3 |
| P | 134.3 |
| Q | 254.4 |
| R | >500 |
| S | >500 |
| T | 361.4 |
| U | 948.8 |
| V | 1624.0 |
| W | 693.8 |
| X | >500 |
| Y | >500 |
| Z | 909.4 |
| AA | 276.0 |
| BB | >500 |
| CC | 224.3 |
| DD | 138.6 |
| EE | >350 |
| FF | 2163.5 |
| GG | 717.8 |
| HH | 1153.3 |
| II | 1078.1 |
| JJ | 566.9 |
| KK | 958.5 |
| LL | 451.9 |
| MM | 431.3 |
| NN | 958.6 |
| 617 | 732.2 |

TABLE 6-continued

| Creep-Rupture Life at 1800° F. (982° C.)/2.5 ksi (17 MPa) | |
|---|---|
| Alloy | Rupture Life (hours) |
| 214 | 196.0 |
| 230 | 915.4 |
| HASTELLOY X | 285 (estimated) |

Certain experimental alloys containing either hafnium or tantalum, were found to exhibit surprisingly greater creep-rupture lives than many of the other experimental alloys. For example, the hafnium-containing Alloy K has a creep-rupture life of 5645.5 hours, and the tantalum-containing alloy N has a creep-rupture life of 1197.3 hours. A comparison of alloys with and without hafnium and tantalum additions is given in Table 7. For comparative purposes, the alloys are grouped according to their nominal base composition. A clear benefit of hafnium and tantalum additions on the creep-rupture life can be seen for all base compositions. However, any beneficial effect of tantalum on the creep-rupture strength must be weighed against any negative effects on the fabricability as described previously in this document.

TABLE 7

| Effects of Hafnium and Tantalum Additions on Creep-Rupture Life 1800° F. (982° C.)/2.5 ksi (17 MPa) | | | |
|---|---|---|---|
| Nominal Base Composition | Alloy | Addition | Creep-Rupture Life |
| Ni—16Cr—20Co—7.5Mo—3.5Al—1Fe—0.25Ti | C | — | 486.1 |
| | K | 0.43 Hf | 5645.5 |
| | L | 0.71 Ta | 566.7 |
| Ni—16Cr—10Co—7.5Mo—3.5Al—10Fe—0.25Ti | G | — | 722.0 |
| | M | 0.38 Hf | 1317.4 |
| | N | 0.78 Ta | 1197.3 |
| Ni—19.5Cr—10Co—7.5Mo—3.5Al—1Fe—0.25Ti | B | — | 534.7 |
| | V | 0.48 Hf | 1624.0 |
| | Z | 1 Ta | 909.4 |
| | FF | 0.34 Hf, 0.51 Ta | 2163.5 |

As mentioned above, the experimental alloys P and Q, both of which contain around 10 wt. % iron, failed the creep-rupture requirement. These alloys contained minor element additions of tungsten and niobium, respectively. It is useful to compare these alloys to alloy G which is similar to these two alloys, but without a tungsten or niobium addition. Alloy G was found to have acceptable creep-rupture life. Therefore, when alloys from this family are at their upper end of the iron range (~10 wt. %) the elements tungsten and niobium appear to have a negative effect on the creep-rupture life. However, when the iron content is lower, for example alloys I and T, tungsten additions do not result in unacceptable creep-rupture lives. Similarly, niobium additions do not result in unacceptable creep-rupture lives when the iron content is lower (alloy T). For these reasons, iron content should be limited to 5 wt. % or less when tungsten or niobium is present as minor element additions. For alloys with greater than 5 wt. % iron, niobium and tungsten should be controlled to impurity level only (approximately 0.2 wt. % and 0.5 wt. % for niobium and tungsten, respectively).

Also mentioned above, alloys AA, CC, and DD failed the creep-rupture requirement. Alloy AA has a Mo level below that required by the present invention, while all the other elements fall within their acceptable ranges. Therefore, it was found that a critical minimum Mo level was necessary for the requisite creep-rupture strength. Similarly, alloys CC and DD both have Al levels which are outside the range of this invention, while all the other elements fall within their acceptable ranges. The mechanisms responsible for the low creep-rupture strength when the Al level is outside the ranges defined by this invention are unknown.

Thermal Stability

The thermal stability of the experimental alloys was tested using a room temperature tensile test following a thermal exposure at 1400° F. (760° C.) for 100 hours. The amount of room temperature tensile elongation (retained ductility) after the thermal exposure can be taken as a measure of an alloy's thermal stability. The exposure temperature of 1400° F. (760° C.) was selected since many nickel-base alloys have the least thermal stability around that temperature range. To have acceptable thermal stability for the applications of interest, it was determined that a retained ductility of greater than 10% is a necessity. Preferably the retained ductility should be greater than 15%. Of the 50 experimental alloys described here, 39 were tested for thermal stability. The results are shown in Table 8. Of these, 37 had a retained ductility of 17% or more—comfortably above the preferred minimum. Alloys BB and DD were the exceptions, both having a retained ductility of less than 10%. Alloy BB has a Mo level greater than the maximum for the alloys of the present invention, while all the other elements fell within their acceptable ranges. Thus, it is believed that this high Mo level was responsible for the poor thermal stability. Similarly, alloy DD had an Al level greater than the maximum for the alloys of the present invention, while all the other elements fell within their acceptable ranges. Thus, the high Al level is believed responsible for the poor thermal stability.

TABLE 8

| Thermal Stability Test | |
|---|---|
| Alloy | % Elongation (retained ductility) after 1400° F. (760° C.)/100 hours |
| A | 24 |
| B | 25 |
| C | 23 |
| D | 25 |
| E | 25 |
| F | 23 |
| G | 23 |
| H | 23 |
| I | 21 |
| J | 19 |
| K | 24 |

TABLE 8-continued

| Thermal Stability Test | |
|---|---|
| Alloy | % Elongation (retained ductility) after 1400° F. (760° C.)/100 hours |
| L | 22 |
| M | 20 |
| N | 22 |
| O | 23 |
| P | 20 |
| Q | 20 |
| R | 21 |
| S | 17 |
| T | 23 |
| U | 23 |
| V | 21 |
| W | 23 |
| X | 21 |
| Y | 23 |
| Z | 20 |
| AA | 22 |
| BB | 2 |
| CC | 29 |
| DD | 7 |
| EE | 18 |
| FF | 22 |
| GG | 20 |
| HH | 17 |
| II | 20 |
| JJ | 23 |
| KK | 20 |
| LL | 21 |
| MM | 18 |

Summarizing the results of the testing for the four key properties (oxidation resistance, fabricability, creep-rupture strength, and thermal stability), alloys A through N, alloys R through X, alloy Z, and EE through LL (30 alloys in all) were found to pass all four key property tests and are thus considered alloys of the present invention. Also considered part of the present invention is alloy Y, which passed the creep-rupture, modified CHRT, and thermal stability tests, but was not tested for oxidation resistance (its aluminum level indicates that alloy Y would have excellent oxidation resistance as well according to the teaching of this specification). Alloy NN is also part of the present invention although it was only tested for creep-rupture strength (which it passed with a creep-rupture life of 958.6 hours). Alloys O, DD, MM, and TT through XX failed the modified CHRT test and thus were determined to have insufficient fabricability (due to poor resistance to strain age cracking). Alloys P, Q, AA, CC, and DD were found to fail the creep-rupture strength requirement. Alloys CC and OO through SS failed the oxidation requirement. Finally, alloys BB and DD failed the thermal stability requirement. Therefore, alloys O, P, Q, AA through DD, MM, and OO through XX (18 in all) are not considered alloys of the present invention. These results are summarized in Table 9. Additionally, seven different commercial alloys were considered alongside the experimental alloys. All seven commercial alloys were found to fail one or more of the key property tests.

TABLE 9

| Experimental Alloy Summary | | |
|---|---|---|
| Alloy | Failed Key Property Test(s) | Alloy of the Present Invention |
| A | | YES |
| B | | YES |
| C | | YES |

TABLE 9-continued

| Experimental Alloy Summary | | |
|---|---|---|
| Alloy | Failed Key Property Test(s) | Alloy of the Present Invention |
| D | | YES |
| E | | YES |
| F | | YES |
| G | | YES |
| H | | YES |
| I | | YES |
| J | | YES |
| K | | YES |
| L | | YES |
| M | | YES |
| N | | YES |
| O | Modified CHRT | NO |
| P | Creep-Rupture | NO |
| Q | Creep-Rupture | NO |
| R | | YES |
| S | | YES |
| T | | YES |
| U | | YES |
| V | | YES |
| W | | YES |
| X | | YES |
| Y | | YES |
| Z | | YES |
| AA | Creep-Rupture | NO |
| BB | Thermal Stability | NO |
| CC | Oxidation, Creep-Rupture | NO |
| DD | Modified CHRT, Creep-Rupture, Thermal Stability | NO |
| EE | | YES |
| FF | | YES |
| GG | | YES |
| HH | | YES |
| II | | YES |
| JJ | | YES |
| KK | | YES |
| LL | | YES |
| MM | Modified CHRT | NO |
| NN | | YES |
| OO | Oxidation | NO |
| PP | Oxidation | NO |
| QQ | Oxidation | NO |
| RR | Oxidation | NO |
| SS | Oxidation | NO |
| TT | Modified CHRT | NO |
| UU | Modified CHRT | NO |
| VV | Modified CHRT | NO |
| WW | Modified CHRT | NO |
| XX | Modified CHRT | NO |

The acceptable experimental alloys contained (in weight percent): 15.3 to 19.9 chromium, 9.7 to 20.0 cobalt, 7.5 to 10.0 molybdenum, 2.72 to 3.78 aluminum, up to 10.4 iron, 0.085 to 0.120 carbon, 0.02 to 0.56 titanium, 0.13 to 0.49 silicon, as well as minor elements and impurities. The acceptable alloys further had values of the term Al+0.56Ti+0.29Nb+0.15Ta which ranged from 2.93 to 3.89.

Perhaps the most critical aspect of this invention is the very narrow window for the element aluminum. A critical aluminum content of at least 2.72 wt. % is required in these alloys to promote the formation of the protective alumina scale—requisite for their excellent oxidation resistance. However, the aluminum content must be controlled to 3.89 wt. % or less to maintain the fabricability of the alloys as defined, in part, by the alloys' resistance to strain-age cracking. This careful control of the aluminum content is a necessity for the alloys of this invention. The narrow aluminum window was also found to be important for the creep-strength of these alloys, as well as the thermal stability.

To illustrate further the criticality of the aluminum ranges it is useful to consider data from the experimental heats in graphical form. FIG. 1 addresses the critical lower limit for aluminum. In this figure the oxidation test results of the tested experimental alloys are plotted against the Al content of the alloy. It is evident that the alloys which contain 2.72 wt. % aluminum or greater all have excellent oxidation resistance, having an average metal affected value less than the required maximum of 2.5 mils/side. Conversely, the alloys with less than the required 2.72 wt. % aluminum all failed the oxidation test requirement. Therefore, FIG. 1 clearly illustrates that a minimum Al content is critical to provide excellent oxidation resistance in these alloys.

Figure 2:
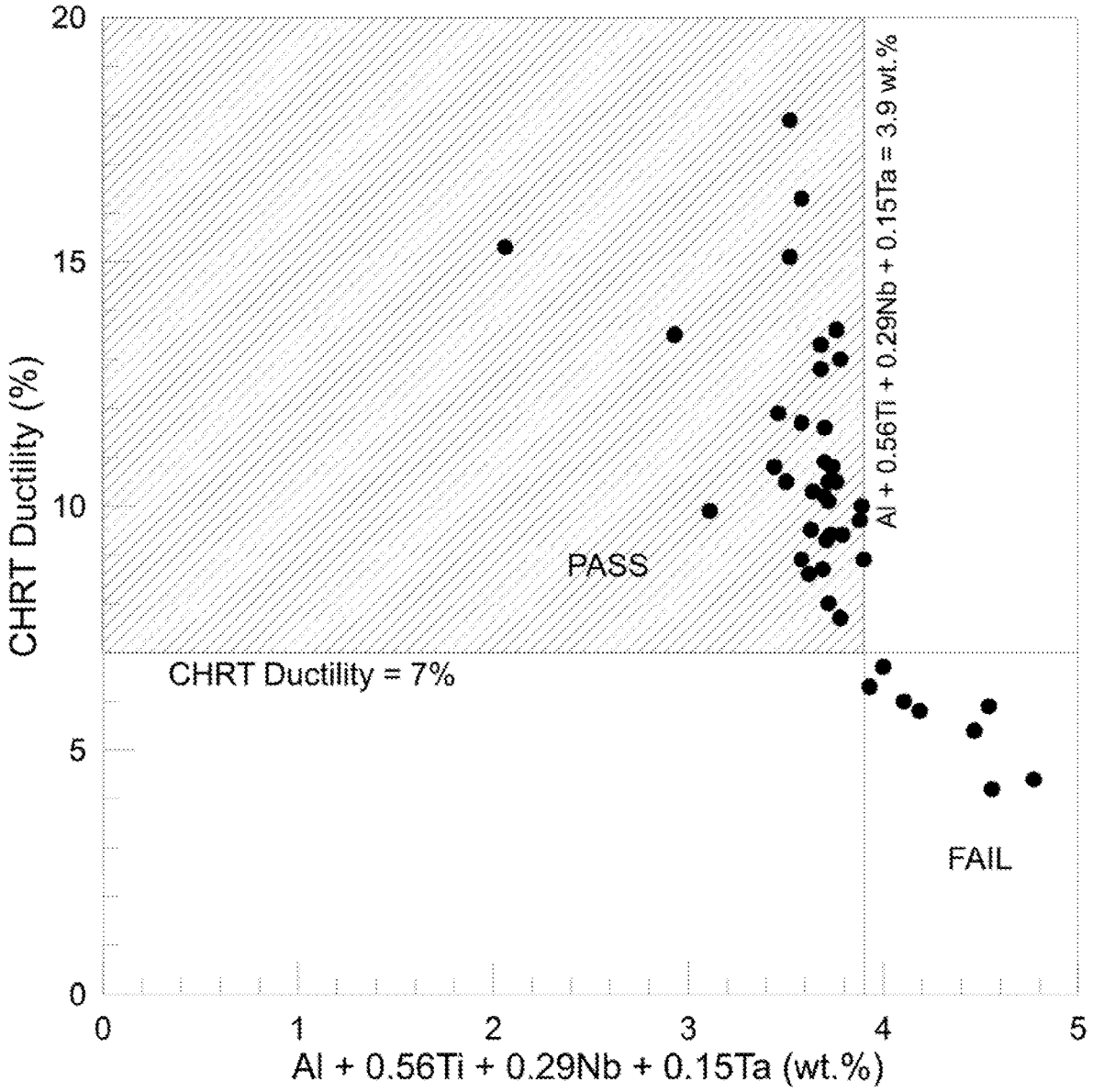
FIG. 2 is a graph of the resistance to strain age-cracking as measured by the modified CHRT test ductility of several experimental Ni—Cr—Co—Mo—Al alloys plotted against the compositional factor Al+0.56Ti+0.29Nb+0.15Ta.

FIG. 2 addresses the upper limit for aluminum. The upper limit is critical to maintain fabricability as defined by the resistance to strain age cracking. This is measured experimentally using the modified CHRT test described previously. In the figure, the result of the CHRT test is plotted against the value of Al+0.56Ti+0.29Nb+0.15Ta. Note that while this is not a direct plot against the aluminum content, the maximum aluminum is content is, of course, limited by this equation. The plot includes all tested experimental alloys with the exception of those excluded by the requirement discussed previously that the Fe level be limited if W or Nb are present (alloys P and Q). In the figure it is evident that alloys where Al+0.56Ti+0.29Nb+0.15Ta is less than or equal to 3.9 all have acceptable CHRT test ductilities. Conversely, alloys where the value is greater than 3.9 all were found to have failing CHRT test ductilities. Therefore, FIG. 2 clearly illustrates that aluminum (along with Ti, Nb, and Ta) should be limited on the upper end using the relationship defined in Equation 1 in order to provide the alloy with adequate resistance to strain age cracking.

The use of Equation 1 to limit the maximum combined aluminum, titanium, niobium, and tantalum in these alloys has certain implications with regards to the maximum aluminum limit. For example, it may be that an alloy (such as alloy O with an aluminum content of 3.60%) may be more susceptible to strain-age cracking than an alloy with higher aluminum (such as alloy S with an aluminum content of 3.78 wt. %). The reason is that the amounts of the other three elements (titanium, niobium, and tantalum) are different between the two alloys. This results in the Al+0.56Ti+0.29Nb+0.15Ta value being too high for alloy O (3.93), but acceptable in alloy S (3.79). Thus, while Equation 1 does limit the maximum aluminum content, the limitation must be understood within the context of the total titanium, niobium, and tantalum content as well.

In addition to the narrow aluminum window, there are other factors crucial to this invention. These include the cobalt and molybdenum additions, which contribute greatly to the creep-rupture strength—a key property of these alloys. In particular, it was found that a critical minimum level of molybdenum was necessary in this particular class of alloys to ensure sufficient creep-strength. Chromium is also crucial due to its contribution to oxidation resistance. Certain minor element additions can provide significant benefits to the alloys of this invention. This includes carbon, a critical (and required) element for imparting creep strength, grain refinement, etc. Also, boron and zirconium, while not required to be present, are preferred to be present due to their beneficial effects on creep-rupture strength. Likewise, rare earth elements, such as yttrium, lanthanum, cerium, etc. are preferred to be present due to their beneficial effects on oxidation resistance. Finally, while all alloys of this invention have high creep-rupture strength, those with hafnium and/or tantalum additions have been found to have unexpectedly pronounced creep-rupture strength.

The criticality of certain elements to the ability of the alloys of this invention to meet the combination of the four key material properties is illustrated by comparison of the present invention to that described by Gresham in U.S. Pat. No. 2,712,498 which overlaps the present invention. In the Gresham patent wide elemental ranges are described which cover vast swaths of compositional space. No attempt is made to describe alloys which possess the combination of the four key material properties required by the present invention. In fact, the Gresham patent describes many alloys which do not meet the requirements of the present invention. For example, the commercial 263 alloy was developed by Rolls-Royce Limited (to whom this patent was assigned) and has been used in the aerospace industry for decades. However, this alloy does not have the excellent oxidation resistance required by the present invention—as was shown in Table 3 above. Furthermore, there is no teaching by Gresham et al. that a critical minimum aluminum level is necessary for oxidation resistance. Another example is alloy DD described in Table 1. This alloy falls within the ranges of the Gresham patent. However, this alloy fails three of the four requirements of the present invention: creep-rupture, resistance to strain-age cracking (as measured by the modified CHRT test), and thermal stability. The failure of alloy DD to pass the strain-age cracking requirement, for example, has been shown in the present specification to be a result of the aluminum level being too high. There is no teaching by Gresham et al. that there is a critical maximum aluminum level (or a maximum combined level of the elements Al, Ti, Nb, and Ta) to avoid susceptibility to strain-age cracking. A third example is that Gresham does not describe the need to limit the maximum molybdenum level to avoid poor thermal stability. In short, Gresham describes alloys which do not meet the combination of four key material properties described herein and does not teach anything about the critical compositional requirements necessary to combine these four properties, including for example, the very narrow acceptable aluminum range.

Uno (JP 2009-167500) discloses a method for producing a nickel based heat resistant alloy having improved machinability. The abstract says that an alloy containing 10 to 30% Cr, 0.1 to 15% Mo, 0.1 to 15% Co, 0.2 to 3% Al, 0.2 to 5% Ti, 0.03 to 0.1% C and the balance Ni with inevitable impurities is subjected to a soaking treatment. The reference is concerned with improving the machinability of Ni-base heat resistant alloys. See paragraphs 0004-0007. There is no concern about or mention of strain-age cracking resistance or thermal stability. While oxidation resistance is mentioned, there is nothing describing how the presence of Al is required to produce excellent oxidation resistance as required by the present invention. Nor is there anything describing that the Al must be present above a critical level to provide the excellent oxidation resistance. Table 1 of Uno contains the only example alloy compositions that are disclosed in this reference. None of the example alloys are even close to our alloy. In all of Uno's example alloys the molybdenum content is too low, the aluminum content is too low, and the titanium content is too high. In all example alloys except example 1, cobalt is not present or is too low.

The compositional ranges disclosed by Uno cover a vast range of disparate alloys, including multiple alloys commercially available for several decades prior to the Uno disclosure. The Uno disclosure, therefore, does not describe an alloy expected to possess certain properties (as does the present specification), but rather describes how their defined methodology is proposed to improve the machinability of many different Ni-alloys. It teaches nothing about an alloy composition or how to find an alloy composition that possesses key properties required by the present application (excellent oxidation resistance, strain-age cracking resistance, and thermal stability).

Hirata et al. disclose austenitic heat resistant alloys which have excellent weldability and are used in constructing high temperature machines and equipment. See paragraph 0028. They discovered that this objective could be achieved by restricting the impurities P, S, Sn, Sb, Pb, Zn, As, O, and N. See paragraph 0031. Hirata et al. (US 2010/0166594) teach that restricting the impurities P, S, Sn, Sb, Pb, Zn, As, O, and N will provide excellent weldability in a wide range of austenitic heat resistant nickel base alloys. While oxidation resistance is mentioned, there is nothing describing how the presence of Al is required to produce excellent oxidation resistance. Nor is there anything describing that the Al must be present above a critical level to provide that excellent oxidation resistance. Furthermore, none of the specific alloy compositions disclosed by Hirata et al. is within the compositional ranges of the alloy disclosed here. The chromium content of all the examples in Table 1 of the Hirata published patent application is greater than 20 and the molybdenum content is below 7.25.

The compositional ranges disclosed by Hirata cover a vast range of disparate alloys, including multiple alloys commercially available for several decades. The Hirata disclosure, therefore, does not describe a specific alloy expected to possess certain properties (as does the present specification), but rather describes how controlling certain impurities may result in improved weldability for many different Ni-alloys. It teaches nothing about an alloy composition or how to find an alloy composition that possesses key properties required by the present application (excellent oxidation resistance, strain-age cracking resistance, and thermal stability).

Paragraph 0092 of Hirata et al. says that the content of Al is set to not more than 3% to ensure creep strength at high temperatures, cautioning, that "when the Al content is excessive, particularly at a constant level exceeding 3%, . . . causes an extreme deterioration in the creep strength and toughness." We discovered, contrary to this teaching, that aluminum could be present above 3% and achieve acceptable creep strength. Example alloys A-O, R, S, U-X, Z, BB, EE-LL, and NN contain more that 3% aluminum and had acceptable creep strength reported in Table 6 above.

The amount of aluminum present in our alloy is critical to achieving the desired properties. The test data presented here shows that the aluminum level must be greater than or equal to 2.72% to provide adequate oxidation resistance. We also discovered that aluminum could be present up to 3.89% to achieve acceptable strain-age cracking resistance and creep strength. There is nothing in either the Uno reference or the Hirata reference that would lead anyone to this critical range for aluminum.

The commercial alloys Waspaloy alloy, 617 alloy, 263 alloy and R-41 alloy fall within the principal elemental ranges disclosed by Hirata et al. as well as Uno. However, these four alloys do not have all of the desired properties of the claimed alloy composition. As can be seen in Table 3 above, in a 1008-hour test at 2100° F., 263 alloy has an average metal affected (a measure of oxidation attack) of 16.5 mils per side, over five times higher than the acceptable high of 3 mils/side, and 617 alloy has an average metal affected of 5.1 mils per side nearly twice the acceptable high of 3 mils/side. This level of oxidation attack indicates that both 617 alloy and 263 alloy do not have the oxidation resistance required for the present invention. Table 4 above reports that R-41 alloy has a CHRT test ductility of 6.9% and Waspaloy has a CHRT test ductility of 6.8%, both below the desired level of greater than 7%, and therefore both alloys have poor resistance to strain-age cracking. One skilled in the art would recognize that these commercial alloys are within the compositions disclosed by Hirata et al. as well as Uno (when taking into account tolerable impurities—see Table 12 below and preceding paragraph) and would know or readily find the oxidation resistance and strain-age cracking resistance of these commercial alloys. Additionally, two other commercial alloys (230 alloy and HASTELLOY X alloy) appear to be within the compositions disclosed by Hirata et al. Given that these two alloys were found to not possess the desired oxidation resistance of our alloy Hirata et al. would not lead a person skilled in the art to the alloy we have discovered. Finally, experimental alloys CC, OO, PP, QQ, RR, and SS were found to lie within the Hirata et al. disclosure and experimental alloy RR was found to lie within the critical elemental ranges of the Uno disclosure. However, these 6 alloys all fail at least one of the key property tests of the present invention.

The alloys of the present invention contain (in weight percent): 15 to 20 chromium, 9.5 to 20 cobalt, 7.25 to 10 molybdenum, 2.72 to 3.89 aluminum, 0.02 to 0.75 titanium, an amount of carbon up to 0.15 and silicon up to 0.6, and the balance nickel plus impurities minor element additions. The ranges for the major elements are summarized in Table 10. Note that three different ranges of the elements are provided: broad, intermediate, and narrow. The "broad range" is sufficient to provide the key properties of this invention. However, the narrower ranges are intended to provide more optimum properties with the "narrow range" being the most optimum and most preferred.

A brief mention of the benefits of the major alloying elements follows, but should not be considered exhaustive. Chromium provides useful oxidation and hot corrosion resistance. Cobalt provides strength and regulates the gamma-prime solvus. Molybdenum is an effective solid-solution strengthener. The benefits and criticality of aluminum were discussed previously.

TABLE 10

Major Element Ranges (in wt. %)

| Element | Broad range | Intermediate range | Narrow range |
|---|---|---|---|
| Ni | balance | Balance | balance |
| Cr | 15 to 20 | 16 to 20 | 18 to 20 |
| Co | 9.5 to 20 | 15 to 20 | 18 to 20 |
| Mo | 7.25 to 10 | 7.25 to 9.75 | 7.25 to 8.25 |
| Al | 2.72 to 3.89 | 2.9 to 3.7 | >3 up to 3.5 |

In addition to carbon, titanium, and silicon, the minor element additions may also include iron, manganese, niobium, tantalum, hafnium, zirconium, boron, tungsten, magnesium, calcium, and one or more rare earth elements (including, but not limited to, yttrium, lanthanum, and cerium). The acceptable ranges of the minor elements are described below and summarized in Table 11. As in Table 10, the broad, intermediate, and narrow ranges given in Table 11 are all expected to provide acceptable key properties with the properties optimized the most for the "narrow range", which is the most preferred.

Titanium in small quantities is an effective carbide former and is believed to provide improved creep strength and may also be beneficial for oxidation resistance. Titanium should be present at a minimum of 0.02 wt. % and preferably 0.2 wt. % or more. Beyond a certain level titanium, no longer provides additional benefits and can, in fact, be detrimental in terms of fabricability. For this reason, the amount of titanium in these alloys should be kept to less than 0.75 wt. % and preferably less than 0.6 wt. %. The benefit of a small quantity of carbon has been described previously.

The element niobium may be present to provide strengthening, but should be limited in quantity due to its adverse effect on certain aspects of fabricability. In particular, an abundance may increase the propensity of an alloy for strain-age cracking. If present, niobium should be limited to no more than 1 wt. %. If not present as an intentional addition, niobium could be present as an impurity up to around 0.2 wt. %.

The presence of the elements hafnium and/or tantalum has unexpectedly been found to be associated with even greater creep-rupture lives in these alloys. Therefore, one or both elements may optionally be added to these alloys to further improve creep-rupture strength. Hafnium may be added at levels up to around 1 wt. %, while tantalum may be added at levels up to around 1.5 wt. %. To be most effective, the sum of the tantalum and hafnium contents should be between 0.2 wt. % and 1.5 wt. %. An additional factor when considering hafnium and tantalum additions is their effect on oxidation resistance. While it was found that both elements could be added while still maintaining acceptable oxidation resistance, it was found that hafnium-containing alloys generally had somewhat less oxidation resistance when compared to alloys without hafnium. Conversely, tantalum additions generally were observed to have no detrimental effect and may actually improve oxidation resistance. For these reasons, tantalum is considered a preferred elemental addition for this invention while hafnium is not. If not present as intentional additions, hafnium and tantalum could be present as impurities up to around 0.2 wt. % each.

To maintain fabricability, certain elements which may or may not be present (specifically, aluminum, titanium, niobium, and tantalum) should be limited in quantity in a manner to satisfy the following additional relationship (where elemental quantities are in wt. %):

$$Al+0.56Ti+0.29Nb+0.15Ta \leq 3.9 \quad [1]$$

Additionally, boron may be present in a small, but effective trace content up to 0.015 wt. % to obtain certain benefits known in the art. While boron was present in all of the experimental alloys and is believed to have some beneficial effects, it is not believed to be essential to achieve the key alloy properties required by this invention.

Tungsten may be added up to around 2 wt. %, but if present as an impurity would typically be around 0.5 wt. % or less. Iron may also be present as an impurity at levels up to around 2 wt. %, or may be an intentional addition at higher levels to lower the overall cost of raw materials. However, iron should not be present more than around 10.5 wt. %. If niobium and/or tungsten are present as minor element additions, the iron content should be further limited to 5 wt. % or less. While most likely present in any commercial alloy due to manufacturing methods, iron is not required in the alloys of this invention as demonstrated by alloy R which contained no iron, but nevertheless passed all key property requirements of the invention. To enable the removal of oxygen and sulfur during the melting process, these alloys typically contain small quantities of manganese up to about 1 wt. %, and silicon up to around 0.6 wt. %, and possibly traces of magnesium, calcium, and rare earth elements (including yttrium, cerium, lanthanum, etc.) up to about 0.05 wt. % each. Silicon is often added in small quantities to high temperature alloys to improve oxidation resistance and for this reason should be present in small amounts in the alloys of this invention, but for thermal stability reasons should be limited to no more than 0.6 wt. %. Zirconium may be present in the alloy as an impurity or intentional addition (for example, to improve creep-rupture life), but should be kept to 0.06 wt. % or less in these alloys to maintain fabricability, preferably 0.04 wt. % or less. While zirconium was present in all of the experimental alloys and is believed to have some beneficial effects, it is not believed to be essential to achieve the key alloy properties required by this invention.

TABLE 11

Minor Element Additions (in wt. %)

| Element | Broad range | Intermediate | Narrow range |
|---|---|---|---|
| C | present up to 0.15 | present up to 0.12 | 0.02 up to 0.12 |
| Ti | 0.02 to 0.75 | 0.2 to 0.75 | 0.2 to 0.6 |
| Si | present up to 0.6 | present up to 0.5 | 0.05 to 0.4 |
| Ta | up to 1.5 | 0.2 to 1.5 | 0.2 to 1 |
| Fe | up to 10.5 | up to 5 | up to 2 |
| Mn | up to 1 | up to 1 | up to 0.5 |
| Nb[a] | up to 1 | up to 1 | up to 1 |
| Hf | up to 1 | up to 1 | up to 0.5 |
| Zr | up to 0.06 | up to 0.04 | present up to 0.04 |
| B | up to 0.015 | up to 0.008 | present up to 0.005 |
| W[a] | up to 2 | up to 2 | up to 0.5 |
| Mg | up to 0.05 | up to 0.05 | up to 0.05 |
| Ca | up to 0.05 | up to 0.05 | up to 0.05 |
| REE[b] | up to 0.05 each | up to 0.05 each | one or more present up to 0.05 each |

[a]Alloys with Nb or W present at higher than impurity levels should also contain ≤5 wt. % Fe
[b]Rare earth elements (REE) include one or more of Y, La, Ce, etc.

A summary of the tolerance for certain impurities is provided in Table 12. Some elements listed in Table 12 (tantalum, hafnium, boron, etc.) may be present as intentional additions rather than impurities; if a given element is present as an intentional addition it should be subject to the ranges defined in Table 11 rather than Table 12. Additional unlisted impurities may also be present and tolerated if they do not degrade the key properties below the defined standards.

TABLE 12

Impurity Tolerances (in wt. %)

| Impurity | Maximum Tolerance |
|---|---|
| Fe | 2* |
| Si | 0.4* |
| Mn | 0.5* |
| Nb | 0.2* |
| Ta | 0.2* |
| Hf | 0.2* |
| Zr | 0.05* |
| B | 0.005* |
| W | 0.5* |
| Cu | 0.5 |
| S | 0.015 |
| P | 0.03 |

*May be higher if an intentional addition (see Table 11)

From the information presented in this specification we can expect that the alloy compositions set forth in Table 13 would also have the desired properties.

TABLE 13

Other Alloy Compositions

| Alloy | Ni | Cr | Co | Mo | Al | Fe | C | Si | Ti | Y | Zr | B | Other |
|---|---|---|---|---|---|---|---|---|---|---|---|---|---|
| 1 | Bal. | 16 | 15 | 8 | 3.89 | 1 | 0.1 | 0.1 | 0.02 | 0.02 | 0.04 | 0.004 | |
| 2 | Bal. | 16 | 15 | 7.25 | 3.3 | 1 | 0.1 | 0.1 | 0.25 | 0.02 | 0.04 | 0.004 | 0.5 Ta |
| 3 | Bal. | 16 | 15 | 8 | 3.3 | 1 | 0.02 | 0.1 | 0.25 | 0.02 | 0.04 | 0.004 | 0.5 Ta |
| 4 | Bal. | 16 | 15 | 8 | 3.3 | 1 | 0.15 | 0.1 | 0.25 | 0.02 | 0.04 | 0.004 | 0.5 Ta |
| 5 | Bal. | 15 | 15 | 8 | 3.3 | 1 | 0.1 | 0.1 | 0.25 | 0.02 | 0.04 | 0.004 | 0.5 Ta |
| 6 | Bal. | 20 | 15 | 8 | 3.3 | 1 | 0.1 | 0.1 | 0.25 | 0.02 | 0.04 | 0.004 | 0.5 Ta |
| 7 | Bal. | 16 | 15 | 8 | 3.3 | 1 | 0.1 | 0.05 | 0.25 | 0.02 | 0.04 | 0.004 | 0.5 Ta |
| 8 | Bal. | 16 | 9.5 | 8 | 3.3 | 1 | 0.1 | 0.1 | 0.25 | 0.02 | 0.04 | 0.004 | 0.5 Ta |
| 9 | Bal. | 16 | 15 | 8 | 3.3 | 1 | 0.1 | 0.1 | 0.02 | 0.02 | 0.04 | 0.004 | 0.5 Ta |
| 10 | Bal. | 16 | 15 | 8 | 3.3 | 1 | 0.1 | 0.1 | 0.25 | 0.02 | — | 0.004 | 0.5 Ta |
| 11 | Bal. | 16 | 15 | 8 | 3.3 | 1 | 0.1 | 0.1 | 0.25 | 0.02 | 0.04 | — | 0.5 Ta |
| 12 | Bal. | 16 | 15 | 8 | 3.3 | 1 | 0.05 | 0.1 | 0.25 | 0.02 | 0.04 | 0.004 | 0.5 Ta |
| 13 | Bal. | 16 | 15 | 8 | 3.3 | 1 | 0.1 | 0.1 | 0.25 | 0.02 | 0.04 | 0.015 | 0.5 Ta |
| 14 | Bal. | 16 | 15 | 8 | 3.3 | 1 | 0.1 | 0.1 | 0.75 | 0.02 | 0.04 | 0.004 | 0.5 Ta |
| 15 | Bal. | 16 | 15 | 8 | 3.3 | 1 | 0.1 | 0.1 | 0.25 | 0.02 | 0.04 | 0.004 | 1 Nb |
| 16 | Bal. | 16 | 15 | 8 | 3.3 | 1 | 0.1 | 0.1 | 0.25 | 0.02 | 0.04 | 0.004 | 1 Hf |
| 17 | Bal. | 16 | 15 | 8 | 3.3 | 1 | 0.1 | 0.1 | 0.25 | 0.02 | 0.04 | 0.004 | 1.5 Ta |
| 18 | Bal. | 16 | 15 | 8 | 3.3 | 10.5 | 0.1 | 0.1 | 0.25 | 0.02 | 0.04 | 0.004 | 0.5 Ta |
| 19 | Bal. | 16 | 15 | 8 | 3.3 | 1 | 0.1 | 0.1 | 0.25 | 0.02 | 0.04 | 0.004 | 1 Mn, 0.5 Ta |
| 20 | Bal. | 16 | 15 | 8 | 3.3 | 1 | 0.1 | 0.5 | 0.25 | 0.02 | 0.04 | 0.004 | 0.5 Ta |
| 21 | Bal. | 16 | 15 | 8 | 3.3 | 1 | 0.1 | 0.6 | 0.25 | 0.02 | 0.04 | 0.004 | 0.5 Ta |
| 22 | Bal. | 16 | 15 | 8 | 3.3 | 1 | 0.1 | 0.1 | 0.25 | 0.02 | 0.06 | 0.004 | 0.5 Ta |
| 23 | Bal. | 16 | 15 | 8 | 3.3 | 1 | 0.1 | 0.1 | 0.25 | 0.02 | 0.04 | 0.008 | 0.5 Ta |
| 24 | Bal. | 16 | 15 | 8 | 3.3 | 1 | 0.1 | 0.1 | 0.5 | 0.02 | 0.04 | 0.004 | 0.5 Ta |
| 25 | Bal. | 16 | 15 | 8 | 3.3 | 1 | 0.1 | 0.1 | 0.25 | 0.02 | 0.04 | 0.004 | 0.5 Hf |
| 26 | Bal. | 16 | 15 | 8 | 3.3 | 1 | 0.1 | 0.1 | 0.25 | 0.02 | 0.04 | 0.004 | 0.5 Ta, 0.2 W |
| 27 | Bal. | 16 | 15 | 8 | 3.3 | 1 | 0.1 | 0.1 | 0.25 | 0.02 | 0.04 | 0.004 | 0.5 Ta, 0.05 Mg |
| 28 | Bal. | 16 | 15 | 8 | 3.3 | 1 | 0.1 | 0.1 | 0.25 | 0.02 | 0.04 | 0.004 | 0.5 Ta, 0.05 Ca |
| 29 | Bal. | 16 | 15 | 8 | 3.3 | 1 | 0.1 | 0.1 | 0.25 | 0.02 | 0.04 | 0.004 | 0.5 Ta, 0.05 La |
| 30 | Bal. | 16 | 15 | 8 | 3.3 | 1 | 0.1 | 0.1 | 0.25 | 0.02 | 0.04 | 0.004 | 0.5 Ta, 0.05 Ce |
| 31 | Bal. | 16 | 15 | 8 | 3.3 | 1 | 0.1 | 0.1 | 0.25 | 0.05 | 0.04 | 0.004 | 0.5 Ta |
| 32 | Bal. | 16 | 15 | 8 | 3.5 | 1 | 0.1 | 0.1 | 0.45 | 0.05 | 0.04 | 0.004 | 1 Ta |

In addition to the four key properties described above, other desirable properties for the alloys of this invention would include: high tensile ductility in the as-annealed condition, good hot cracking resistance during welding, good thermal fatigue resistance, and others.

Even though the samples tested were limited to wrought sheet, the alloys should exhibit comparable properties in other wrought forms (such as plates, bars, tubes, pipes, forgings, and wires) and in cast, spray-formed, additive manufactured (include the powder to produce such), or powder metallurgy forms, namely, powder, compacted powder and sintered compacted powder. Consequently, the present invention encompasses all forms of the alloy composition.

The data presented in Tables 3, 4, 6, 7, and 8 above resulted from tests where the material was originally in the annealed condition (note that for Table 8 a thermal exposure of 1400° F. was administered to the annealed samples prior to the test). However, it is not necessary that the alloys of the present invention be in the annealed condition to have the desired combination of improved key properties. The alloys of this invention could be in other material conditions that include, but are not limited to, hot or cold worked material, age-hardened material, as-produced or heat treated weldments, castings, or additively manufactured material, powder products, etc. While testing in some of these material conditions may change the absolute values measured in the key property tests, the alloys of this invention will still possess the same improved properties relative to other alloys. The tests described herein were designed to show the effect of composition on the key properties. Specifically, the processing and annealing of the test samples were controlled to produce a similar microstructure in all of the tested samples.

We will now discuss the four key properties of the alloys of the present invention in relation to different material conditions.

1) Oxidation: The ability to resist oxidation is the principal feature of the alloys of this invention. We have found that the ability to resist oxidation is very strongly dependent of the aluminum level in the alloy. A critical amount of aluminum (2.72 wt. %) was found to be necessary in this type of alloy. Because the oxidation resistance of an alloy is determined almost entirely by the composition of the alloy one would expect that the excellent oxidation resistance found in the annealed sheet form that was tested would be present in other material conditions of the same composition.

2) Fabricability: A key feature of the alloys of the present invention is their high fabricability, or more specifically their resistance to strain-age cracking. The CHRT test has been used as a measure of an alloy's resistance to strain-age cracking. This test is performed on material in the annealed condition. Alloys with lower elongation values are more likely to suffer strain-age cracking and those with higher elongation values are less likely. The idea of the test is to determine the ability of the alloy to resist strain-age cracking and is done in a comparative manner—for this reason it is best to compare alloys using the same starting condition, for example, the annealed condition. In reality, concerns about strain-age cracking are normally for more complex material conditions. The most obvious condition is an as-welded component being slowly cooled or subsequently being subjected to heat treatment. Field experience has shown that an alloy's resistance to strain-age cracking in these real world conditions can be predicted from CHRT testing of annealed material. This has been discussed in the paper by Rowe (*Welding Journal* supplement, February 2006, pp. 27s-34s), and more recently by field experience demonstrating the excellent weldability/fabricability of HAYNES 282 alloy which was predicted to have excellent strain-age cracking resistance based on CHRT test results (see U.S. Pat. No. 8,066,938, also L. M. Pike, "Development of a Fabricable Gamma-Prime (γ') Strengthened Superalloy", *Superalloys* 2008—Proceedings of the 11th International Symposium on Superalloys, p. 191-200, 2008). The fact that the CHRT test results presented in this document (Table 4) are for annealed material does not imply the alloy must be in the annealed condition to have good strain-age cracking resistance. In fact, those skilled in the art would expect the strain-age cracking resistance of the alloys of the present invention to remain good relative to other gamma-prime forming alloys in a number of relevant material conditions (particularly in light of the fact that we have demonstrated the very strong dependence of strain-age cracking resistance on alloy composition). These could include weldments, castings, additively manufactured components, other powder-processed components, etc.

3) Creep-Rupture Strength: The high creep-strength of the alloys of the present invention is another key property. The data presented in Tables 6 and 7 for material in the annealed condition. Testing in other material conditions (which would result in a different microstructure) could be expected to have an effect on the creep-rupture strength. There are a number of effects of material condition/microstructure which can alter creep-rupture strength. These could include grain size, whether the material has been annealed after cold/hot work, and cooling rate from the annealing step. The testing whose results are presented in Tables 6 and 7 was intentionally done in such a way to eliminate most material/microstructural variables so that the effect of composition alone could be best evaluated. For example, all the tests were done on samples in the annealed condition. Furthermore, all the experimental alloys were annealed at a temperature which resulted in a grain size between 3½ and 4½ and then water quenched. This eliminated the key material/microstructural variables of grain size and cooling rate. As a result, the observed differences in creep strength can be attributed primarily to alloy composition. If tested in other material conditions the creep strength may be expected to change, but the benefits of the alloy compositions of the present invention will be present.

4) Thermal Stability: The ability to remain stable after thermal exposure is an important property of the alloys of the present invention. Thermal stability is a measure of the phases that remain/form in the material after long term thermal exposure and the effect of those phases on the mechanical properties. Often this is measured by considering the retained room temperature tensile ductility after long term thermal exposure. The ductility data in Table 8 is from samples exposed at 1400° F. for 100 hours after being annealed. The likelihood of the formation of additional phases after long term thermal exposure is a function of both thermodynamic and kinetic factors. In both cases, the alloy composition is the most dominant variable. However, since certain microstructural variables may have minor effects as well, the tests presented in Table 8 were all performed on material thermally exposed at 1400° F. for 100 hours after being annealed to a grain size between 3½ and 4½ and then water quenched. This eliminated the key material/microstructural variables of grain size and cooling rate. As a result, the observed differences in thermal stability can be attributed primarily to alloy composition. If tested using other initial material conditions the retained ductility after thermal exposure may be expected to change, but the benefits of the alloy compositions of the present invention will be present.

Although the oxidation test results given in Table 3 are for annealed material, it would be obvious to those skilled in the art, that while changes to the material condition may have minor effects on oxidation resistance they would be much less than the effect of composition. To prove this, we have conducted some additional oxidation tests. Samples from one of the alloys of this invention (composition given in Table 14 below) were tested using the same oxidation test as was used for the sample in Table 3. In addition to the annealed condition, samples were tested in three other material conditions: age-hardened, hot worked, and cold worked. The results are given in Table 15 below. It can clearly be seen in the table that the oxidation resistance was excellent in all material conditions and easily passed the requirement of an average metal affected value of 2.5 mils/side (64 μm/side) or less. Therefore, the excellent oxidation resistance of the alloys of this invention relative to other alloys can be expected regardless of material condition.

TABLE 14

Composition (in wt. %) of the Alloy in the Oxidation Test Reported in Table 15

| Ni | Cr | Co | Mo | Al | Fe | C | Si | Mn | Ti | Y | Zr | B | Other |
|---|---|---|---|---|---|---|---|---|---|---|---|---|---|
| Bal. | 18.9 | 19.0 | 7.5 | 3.15 | 1.0 | 0.09 | 0.15 | 0.20 | 0.60 | 0.004 | 0.02 | 0.002 | 0.52 Ta, 0.1 W |

TABLE 15

2100° F. (1149° C.) Oxidation Test Results

| Condition | Average Metal Affected (mils/side) | Average Metal Affected (μm/side) |
|---|---|---|
| annealed | 0.7 | 18 |
| age-hardened | 0.7 | 18 |
| cold worked | 0.6 | 15 |
| hot worked | 0.7 | 18 |

Based on the above discussions, it is clear that the improved key properties of the alloys of the present invention result from the defined alloy compositions and that these alloys can be expected to possess the improved properties relative to those of other alloys regardless of material condition. For this reason, the present invention encompasses all material/microstructural conditions of the alloy composition defined in the claims.

The combined properties of excellent oxidation resistance, good fabricability, high creep-rupture strength, and good thermal stability exhibited by this alloy make it particularly useful for fabrication into gas turbine engine components and particularly useful for combustors in these engines. Such components and engines containing these components can be operated at higher temperatures without failure and should have a longer service life than those components and engines currently available.

Although we have disclosed certain preferred embodiments of the alloy, it should be distinctly understood that the present invention is not limited thereto, but may be variously embodied within the scope of the following claims.

We claim:

1. A nickel-chromium-cobalt-molybdenum-aluminum based alloy that when in annealed sheet form has an average metal affected value of not more than 3 mils/side when subjected to oxidation testing in flowing air at 2100° F. for 1008 hours, has a creep-rupture life of at least 325 hours when tested at 1800° F. under a load of 2.5 ksi, has ductility of greater than 10% when tested using a room temperature tensile test following a thermal exposure at 1400° F. for 100 hours, and has a modified CHRT test ductility greater than 7% when tested at 1450° F., the alloy having a composition comprised in weight percent of:

| | |
|---|---|
| 15 to 20 | chromium |
| 9.5 to 20 | cobalt |
| 7.25 to 10 | molybdenum |
| 2.72 to 3.89 | aluminum |
| up to 10.5 | iron |
| 0.02 to 0.75 | titanium |
| present up to 0.15 | carbon |
| present up to 0.6 | silicon |
| up to 0.015 | boron |
| up to 0.2 | niobium |
| up to 0.5 | tungsten |
| up to 1.5 | tantalum |
| up to 1 | hafnium |
| up to 1 | manganese |
| up to 0.06 | zirconium |

with a balance of nickel and impurities, the alloy further satisfying the following compositional relationship defined with elemental quantities being in terms of weight percent:

$$Al+0.56Ti+0.29Nb+0.15Ta \leq 3.9.$$

2. The nickel-chromium-cobalt-molybdenum-aluminum based alloy of claim 1, containing titanium, from 0.2 to 0.75 wt. %.

3. The nickel-chromium-cobalt-molybdenum-aluminum based alloy of claim 1, containing tantalum, from 0.2 to 1.5 wt. %.

4. The nickel-chromium-cobalt-molybdenum-aluminum based alloy of claim 1, containing hafnium, from 0.2 to 1 wt. %.

5. The nickel-chromium-cobalt-molybdenum-aluminum based alloy of claim 1, containing both of the elements hafnium and tantalum where the sum of the two elements is between 0.2 and 1.5 wt. %.

6. The nickel-chromium-cobalt-molybdenum-aluminum based alloy of claim 1, containing traces of at least one of magnesium, calcium, and any rare earth elements up to 0.05 wt. %.

7. The nickel-chromium-cobalt-molybdenum-aluminum based alloy of claim 1, containing at least one of the following impurities: copper up to 0.5 wt. %, sulfur up to 0.015 wt. %, and phosphorous up to 0.03 wt. %.

8. The nickel-chromium-cobalt-molybdenum-aluminum based alloy of claim 1 wherein the alloy contains in weight percent:

| | |
|---|---|
| 16 to 20 | chromium |
| 15 to 20 | cobalt |
| 7.25 to 9.75 | molybdenum |

-continued

| | |
|---|---|
| 2.9 to 3.7 | aluminum |
| up to 5 | iron |
| 0.2 to 0.75 | titanium |
| present up to 0.12 | carbon |
| present up to 0.5 | silicon |
| up to 0.008 | boron |
| 0.2 to 1.5 | tantalum |
| up to 0.04 | zirconium. |

9. The nickel-chromium-cobalt-molybdenum-aluminum based alloy of claim 1, wherein the alloy contains in weight percent:

| | |
|---|---|
| 18 to 20 | chromium |
| 18 to 20 | cobalt |
| 7.25 to 8.25 | molybdenum |
| >3 to 3.5 | aluminum |
| up to 2 | iron |
| 0.2 to 0.6 | titanium |
| 0.02 to 0.12 | carbon |
| 0.05 to 0.4 | silicon |
| present up to 0.005 | boron |
| 0.2 to 1 | tantalum |
| up to 0.5 | hafnium |
| up to 0.5 | manganese |
| present up to 0.04 | zirconium. |

10. A nickel-chromium-cobalt-molybdenum-aluminum based alloy that when in annealed sheet form has an average metal affected value of not more than 3 mils/side when subjected to oxidation testing in flowing air at 2100° F. for 1008 hours, has a creep-rupture life of at least 325 hours when tested at 1800° F. under a load of 2.5 ksi, has ductility of greater than 10% when tested using a room temperature tensile test following a thermal exposure at 1400° F. for 100 hours, and has a modified CHRT test ductility greater than 7% when tested at 1450° F., the alloy having a composition comprised in weight percent of:

| | |
|---|---|
| 15 to 20 | chromium |
| 9.5 to 20 | cobalt |
| 7.25 to 10 | molybdenum |
| 2.72 to 3.89 | aluminum |
| up to 5 | iron |
| 0.02 to 0.75 | titanium |
| present up to 0.15 | carbon |
| present up to 0.6 | silicon |
| up to 0.015 | boron |
| up to 1 | niobium |
| up to 1.5 | tantalum |
| up to 1 | hafnium |
| up to 2 | tungsten |
| up to 1 | manganese |
| up to 0.06 | zirconium |

with a balance of nickel and impurities, the alloy further satisfying the following compositional relationship defined with elemental quantities being in terms of weight percent:

$$Al+0.56Ti+0.29Nb+0.15Ta \leq 3.9.$$

11. The nickel-chromium-cobalt-molybdenum-aluminum based alloy of claim 10, containing titanium, from 0.2 to 0.75 wt. %.

12. The nickel-chromium-cobalt-molybdenum-aluminum based alloy of claim 10, containing tantalum, from 0.2 to 1.5 wt. %.

13. The nickel-chromium-cobalt-molybdenum-aluminum based alloy of claim 10, containing hafnium, from 0.2 to 1 wt. %.

14. The nickel-chromium-cobalt-molybdenum-aluminum based alloy of claim 10, containing niobium, from 0.2 to 1 wt. %.

15. The nickel-chromium-cobalt-molybdenum-aluminum based alloy of claim 10, containing at least two of hafnium, tantalum, and niobium, where the sum of these elements is between 0.2 wt. % and 1.5 wt. %.

16. The nickel-chromium-cobalt-molybdenum-aluminum based alloy of claim 10, containing traces of at least one of magnesium, calcium, and any rare earth elements up to 0.05 wt. %.

17. The nickel-chromium-cobalt-molybdenum-aluminum based alloy of claim 10, containing at least one of: copper up to 0.5 wt. %, sulfur up to 0.015 wt. %, and phosphorous up to 0.03 wt. %.

18. The nickel-chromium-cobalt-molybdenum-aluminum based alloy of claim 10 wherein the alloy contains in weight percent:

| | |
|---|---|
| 16 to 20 | chromium |
| 15 to 20 | cobalt |
| 7.25 to 9.75 | molybdenum |
| 2.9 to 3.7 | aluminum |
| 0.2 to 0.75 | titanium |
| present up to 0.12 | carbon |
| present up to 0.5 | silicon |
| up to 0.008 | boron |
| 0.2 to 1.5 | tantalum |
| up to 0.04 | zirconium. |

19. The nickel-chromium-cobalt-molybdenum-aluminum based alloy of claim 10, wherein the alloy contains in weight percent:

| | |
|---|---|
| 18 to 20 | chromium |
| 18 to 20 | cobalt |
| 7.25 to 8.25 | molybdenum |
| >3 to 3.5 | aluminum |
| up to 2 | iron |
| 0.2 to 0.6 | titanium |
| 0.02 to 0.12 | carbon |
| 0.05 to 0.4 | silicon |
| present up to 0.005 | boron |
| 0.2 to 1 | tantalum |
| up to 0.5 | hafnium |
| up to 0.5 | tungsten |
| up to 0.5 | manganese |
| present up to 0.04 | zirconium. |

20. A nickel-chromium-cobalt-molybdenum-aluminum based alloy that when in annealed sheet form has an average metal affected value of not more than 3 mils/side when subjected to oxidation testing in flowing air at 2100° F. for 1008 hours, has a creep-rupture life of at least 325 hours when tested at 1800° F. under a load of 2.5 ksi, has ductility of greater than 10% when tested using a room temperature tensile test following a thermal exposure at 1400° F. for 100 hours, and has a modified CHRT test ductility greater than 7% when tested at 1450° F., the alloy having a composition comprised in weight percent of:

| | |
|---|---|
| 15.3 to 19.9 | chromium |
| 9.7 to 20.0 | cobalt |
| 7.5 to 10.0 | molybdenum |
| 2.72 to 3.78 | aluminum |
| up to 10.4 | iron |
| 0.02 to 0.49 | titanium |
| 0.085 to 0.120 | carbon |

-continued

| | |
|---|---|
| 0.002 to 0.005 | boron |
| up to 0.2 | niobium |
| up to 0.5 | tungsten |
| 0.13 to 0.49 | silicon |
| up to 1.0 | tantalum |
| up to 0.48 | hafnium |
| up to 0.5 | manganese |
| up to 0.02 | yttrium |
| 0.01 to 0.04 | zirconium |

with a balance of nickel and impurities, the alloy further satisfying the following compositional relationship defined with elemental quantities being in terms of weight percent:

$$Al+0.56Ti+0.29Nb+0.15Ta \leq 3.89.$$

21. The nickel-chromium-cobalt-molybdenum-aluminum based alloy of claim 20, containing traces of at least one of magnesium, calcium, and any rare earth elements up to 0.05 wt. %.

22. The nickel-chromium-cobalt-molybdenum-aluminum based alloy of claim 20, containing one or more of the following as impurities: niobium up to 0.2 wt. %, tungsten up to 0.5 wt. %, copper up to 0.5 wt. %, sulfur up to 0.015 wt. %, and phosphorous up to 0.03 wt. %.

23. A nickel-chromium-cobalt-molybdenum-aluminum based alloy that when in annealed sheet form has an average metal affected value of not more than 3 mils/side when subjected to oxidation testing in flowing air at 2100° F. for 1008 hours, has a creep-rupture life of at least 325 hours when tested at 1800° F. under a load of 2.5 ksi, has ductility of greater than 10% when tested using a room temperature tensile test following a thermal exposure at 1400° F. for 100 hours, and has a modified CHRT test ductility greater than 7% when tested at 1450° F., the alloy having a composition comprised in weight percent of:

| | |
|---|---|
| 15.3 to 19.9 | chromium |
| 9.7 to 20.0 | cobalt |
| 7.5 to 10.0 | molybdenum |
| 2.72 to 3.78 | aluminum |
| up to 4.5 | iron |
| 0.02 to 0.49 | titanium |
| 0.085 to 0.120 | carbon |
| 0.002 to 0.005 | boron |
| up to 1.0 | niobium |
| up to 1.94 | tungsten |
| 0.13 to 0.49 | silicon |
| up to 1.0 | tantalum |
| up to 0.48 | hafnium |
| up to 0.5 | manganese |
| up to 0.02 | yttrium |
| 0.01 to 0.04 | zirconium. |

with a balance of nickel and impurities, the alloy further satisfying the following compositional relationship defined with elemental quantities being in terms of weight percent:

$$Al+0.56Ti+0.29Nb+0.15Ta \leq 3.89.$$

24. The nickel-chromium-cobalt-molybdenum-aluminum based alloy of claim 23, containing traces of at least one of magnesium, calcium, and any rare earth elements up to 0.05 wt. %.

25. The nickel-chromium-cobalt-molybdenum-aluminum based alloy of claim 23, containing one or more of the following as impurities: niobium up to 0.2 wt. %, tungsten up to 0.5 wt. %, copper up to 0.5 wt. %, sulfur up to 0.015 wt. %, and phosphorous up to 0.03 wt. %.

* * * * *